US008532510B2

(12) United States Patent
Murasaki et al.

(10) Patent No.: US 8,532,510 B2
(45) Date of Patent: Sep. 10, 2013

(54) IMAGE FORMING APPARATUS WITH IMAGE DETECTOR

(75) Inventors: Satoshi Murasaki, Suntou-gun (JP); Takaomi Uezono, Suntou-gun (JP); Yasuhisa Matsumoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 252 days.

(21) Appl. No.: 12/784,036

(22) Filed: May 20, 2010

(65) Prior Publication Data

US 2010/0316400 A1 Dec. 16, 2010

(30) Foreign Application Priority Data

Jun. 12, 2009 (JP) ..... 2009-141621
Feb. 25, 2010 (JP) ..... 2010-041005

(51) Int. Cl.
*G03G 15/00* (2006.01)

(52) U.S. Cl.
USPC ..... 399/49; 399/50; 399/53; 399/66; 399/299; 399/300

(58) Field of Classification Search
USPC ..... 399/49, 50, 53, 66, 299, 300
See application file for complete search history.

(56) References Cited

U.S. PATENT DOCUMENTS

2006/0216061 A1* 9/2006 Yamaguchi ..... 399/111
2010/0124427 A1 5/2010 Sugiyama

FOREIGN PATENT DOCUMENTS

JP 2001-318506 A 11/2001
JP 2003-015369 A 1/2003
JP 2003-345195 A 12/2003
JP 2006-072209 A 3/2006
JP 2006-292868 A 10/2006

OTHER PUBLICATIONS

Communication and European Search Report dated Oct. 8, 2010, ("European Search Report") in counterpart European Application No. 10164569.5-2209.

* cited by examiner

*Primary Examiner* — Ryan Walsh
(74) *Attorney, Agent, or Firm* — Fitzpatrick, Cella, Harper & Scinto

(57) ABSTRACT

In an electrophotographic image forming apparatus employing a contact development system, contact of a development roller against a photosensitive drum is started while forming an electrostatic latent image of a detection pattern for detection in each individual apparatus, and a developed toner image is detected at a predetermined position. At this time, a time from the time when contact of the development roller was started until the time when the toner image was detected is measured, and a delay time from a time when contact operation of the development roller was started until a time of actual contact is calculated by subtracting the time needed until the developed toner image reaches the detection position. The time when contact of the development roller is started is delayed by this time. The same sort of control is also performed for the separation time.

28 Claims, 24 Drawing Sheets

DETECTION PATTERN= ※

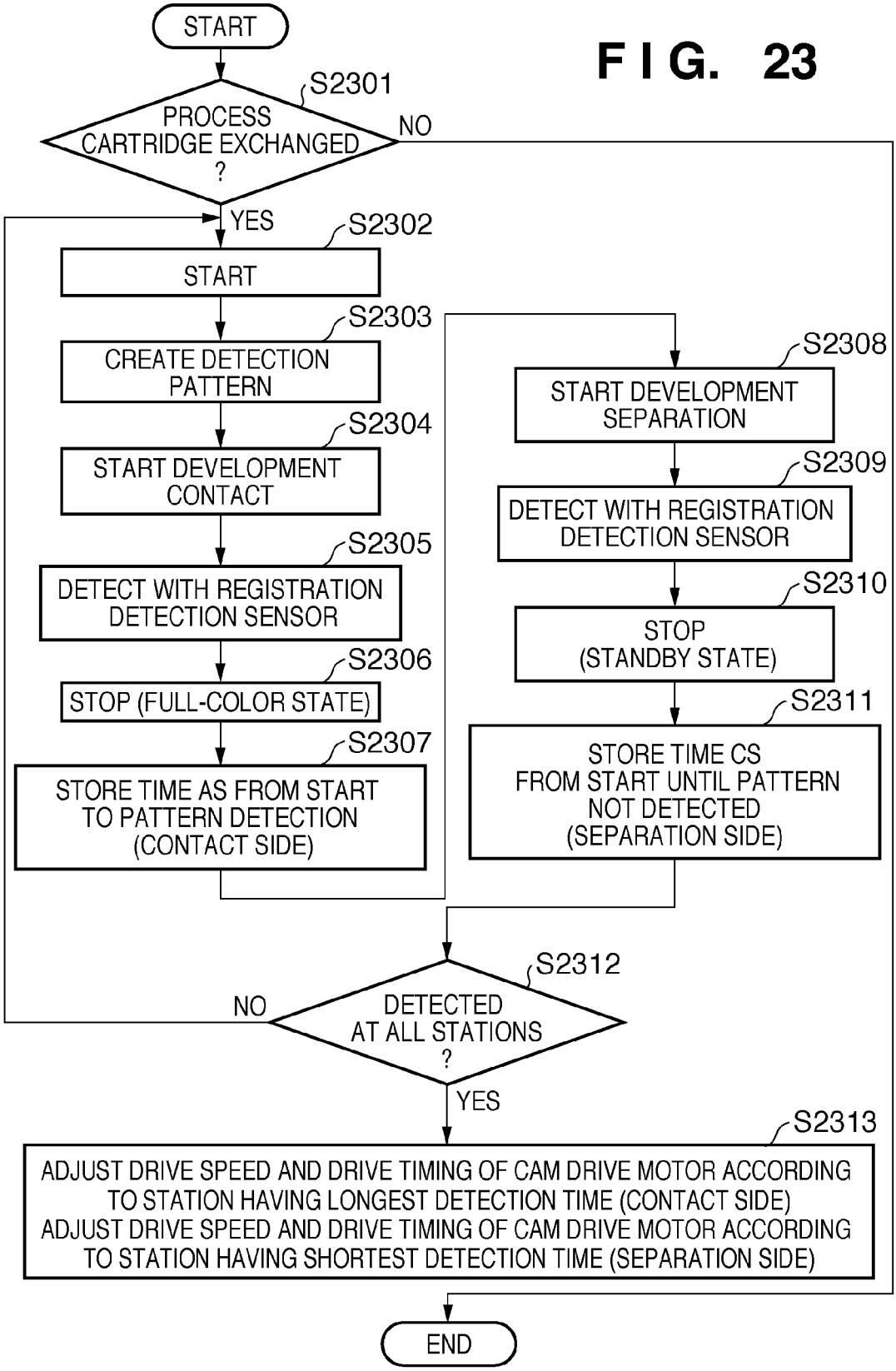
FIG. 23
START
S2301
PROCESS CARTRIDGE EXCHANGED ?
NO
YES
S2302
START
S2303
CREATE DETECTION PATTERN
S2304
START DEVELOPMENT CONTACT
S2305
DETECT WITH REGISTRATION DETECTION SENSOR
S2306
STOP (FULL-COLOR STATE)
S2307
STORE TIME AS FROM START TO PATTERN DETECTION (CONTACT SIDE)
S2308
START DEVELOPMENT SEPARATION
S2309
DETECT WITH REGISTRATION DETECTION SENSOR
S2310
STOP (STANDBY STATE)
S2311
STORE TIME CS FROM START UNTIL PATTERN NOT DETECTED (SEPARATION SIDE)
S2312
DETECTED AT ALL STATIONS ?
NO
YES
S2313
ADJUST DRIVE SPEED AND DRIVE TIMING OF CAM DRIVE MOTOR ACCORDING TO STATION HAVING LONGEST DETECTION TIME (CONTACT SIDE)
ADJUST DRIVE SPEED AND DRIVE TIMING OF CAM DRIVE MOTOR ACCORDING TO STATION HAVING SHORTEST DETECTION TIME (SEPARATION SIDE)
END

IMAGE FORMING APPARATUS WITH IMAGE DETECTOR

BACKGROUND OF THE INVENTION

1. Field of the Invention

The present invention relates to an image forming apparatus employing an electrophotographic system, such as a copy machine, a printer, or a facsimile machine, for example.

2. Description of the Related Art

As one development system of an image forming apparatus employing an electrophotographic process, there is a contact development system in which development is performed in a state in which a development roller, which is a developer carrier, is rotated in contact with a photosensitive drum, which is an image carrier. In the contact development system, the surface of the photosensitive drum wears due to contact with the development roller and thus performance worsens, leading to a decrease in the quality of formed images. Consequently, technology has been proposed whereby wear of the photosensitive drum due to contact with the development roller is prolonged by performing development by causing the development roller to contact the photosensitive drum only during a time period in which an electrostatic latent image of the photosensitive drum is developed.

In Japanese Patent Laid-Open No. 2006-292868, a configuration is proposed in which, in an inline color image forming apparatus, driving and stopping of a development roller, and contact with and separation from the photosensitive drum, are performed in coordination with the timing at which development is performed at respective stations. In an inline system, image forming stations that form images of respective color components are disposed in series on an intermediate transfer belt, and toner images of the respective color components are formed in an image forming region in the order first image forming station (abbreviated below as st1)→st2→st3→st4 in the conveyance direction of the intermediate transfer belt. In Japanese Patent Laid-Open No. 2006-292868, driving and stopping of the development roller of the respective image forming stations, and contact with and separation from the photosensitive drum, are controlled according to this order. The inline system is also referred to as a tandem system.

Here, because the respective image forming stations are provided individually as exchangeable and comparatively inexpensive process cartridges, it is difficult to completely eliminate variation, that is, mechanical variation such as variation in the positional relationship with the main body of the image forming apparatus, variation in drive source control, and so forth. Variation arises in the mechanism for causing contact and separation of a photosensitive drum and a development roller, for example. Assume a mechanism is adopted in which the development roller is biased such that the development roller contacts with the photosensitive drum, and the development roller is caused by a cam mechanism to separate from the photosensitive drum against this biasing force. In this case, assuming that a cam is in the image forming apparatus main body, and a cam follower is in a process cartridge, there is a possibility of variation in the distance between the cam and the cam follower. This variation leads to an offset in the timing of contact and separation of the development roller and the photosensitive drum, the offset occurring between image forming stations or between process cartridges, and the timing offset can cause image defects. For example, when the contact timing of the development roller is later than the leading edge of an image forming region on the photosensitive drum, a leading edge portion of an image is omitted, or image defects occur due to contact shock of the development roller. Also, when the separation timing of the development roller is earlier than the trailing edge of the image forming region on the photosensitive drum, an image defect that the image trailing edge is omitted will occur. Note that the image forming region on the photosensitive drum is a region where a latent image (and eventually a visible image using toner) is formed on the surface of the photosensitive drum according to the size of the recording medium on which printing is performed.

In order to prevent these adverse effects arising due to variation in the timing of contact or separation of the development roller and the photosensitive drum, in Japanese Patent Laid-Open No. 2006-292868, control of driving and stoppage, and contact and separation, of the development roller is caused to have a margin preceding an image forming guarantee time, as shown in FIG. 24. The margin is, for example, a surplus time for absorbing variation in the time required from the start of movement until actual contact in order to cause the development roller to contact against the photosensitive drum. When the development roller has been moved from a position separated from the photosensitive drum to a position contacted against the photosensitive drum, if the margin time has passed after the start of movement, the development roller is guaranteed to be in a state contacted against the photosensitive drum regardless of variation in timing between image forming stations. Accordingly, the time subsequent to passage of the margin time after the start of movement of the development roller serves as the image forming guarantee time, in which image forming of a visible image by a developer using toner or the like is guaranteed. In the example in FIG. 24, the development roller is contacted against the photosensitive drum at a timing t241, and this contact is accelerated by the time of an offset 1 relative to the image forming guarantee time. Also, following image forming, in order to guarantee image forming, separation of the development roller contacted against the photosensitive drum is started after passage of the image forming guarantee time. In FIG. 24, a time corresponding to an offset 2 is required until actual separation. The occurrence of image forming defects is prevented by performing image forming while allowing for this sort of offset.

Therefore, in the example in FIG. 24, the development roller and the photosensitive drum are contacted for a time longer than the image forming guarantee time by offset 1+offset 2. That is, because an image forming guarantee time allowing for offset is ensured, when performing image forming, in many cases it can be assumed that the development roller and the photosensitive drum are in contact for a long period at least as long as the time necessary and sufficient for image forming. As a result, there is the problem that wear of the photosensitive drum advances due to contact that is not intrinsically necessary for image forming, so the life of the process cartridge is shortened.

SUMMARY OF THE INVENTION

The present invention was made in view of the problem described above, and relates to providing an image forming apparatus in which it is possible to postpone wear of a process cartridge by adaptively controlling the time that a development roller and a photosensitive drum are in contact.

According to an aspect of the present invention, an image forming apparatus comprises: an image carrier on which a latent image is formed; and a developing unit adapted to develop the latent image formed on the image carrier as a toner image; wherein the developing unit includes a developer carrier that is capable of contacting or separating from the image carrier and carries a toner image, and the image forming apparatus has a detector adapted to detect a toner image obtained by starting a contact operation to put the image carrier and the developer carrier in contact to develop the latent image while operating the developing unit in a state in which the image carrier and the developer carrier are separated, and a controller adapted to control the contact operation to put the image carrier and the developer carrier in contact based on the detection results detected by the detector.

According to another aspect of the present invention, an image forming apparatus comprises: an image carrier on which a latent image is formed; and a developing unit adapted to develop the latent image formed on the image carrier as a toner image; wherein the developing unit includes a developer carrier that is capable of contacting or separating from the image carrier and carries a toner image, and the image forming apparatus has a detector for detecting a toner image obtained by starting a separation operation to separate the image carrier and the developer carrier to develop the latent image while operating the developing unit in a state in which the image carrier and the developer carrier are in contact, and a controller adapted to control the separation operation to separate the image carrier and the developer carrier based on the detection results detected by the detector.

According to still another aspect of the present invention, an image forming apparatus comprises: an image carrier on which a latent image is formed; and a developer carrier that develops the latent image formed on the image carrier; the image forming apparatus being capable of switching between a state in which the image carrier and the developer carrier are separated, and a state in which the image carrier and the developer carrier are in contact and the latent image can be developed; wherein the latent image formed on the image carrier is developed as a detection image for controlling a contact operation or a separation operation of the image carrier and the developer carrier.

Further features of the present invention will become apparent from the following description of exemplary embodiments with reference to the attached drawings.

BRIEF DESCRIPTION OF THE DRAWINGS

FIG. 23 is a flow diagram of a control program that detects timing of contact/separation of the photosensitive drum and the development roller in the fourth embodiment.

DESCRIPTION OF THE EMBODIMENTS

First Embodiment

Figure 1:
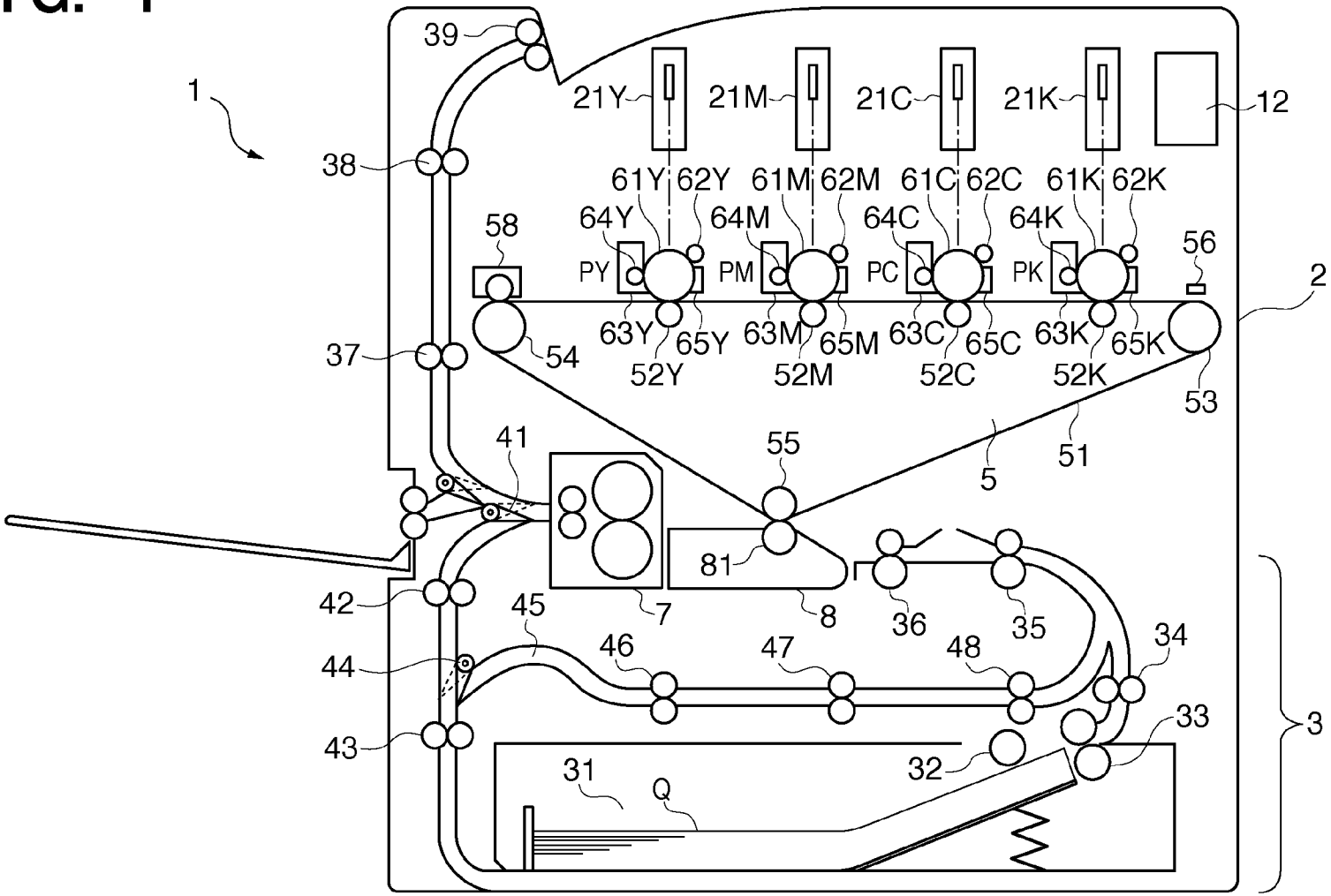
FIG. 1 is a cross-sectional view of an inline-type full-color printer according to an embodiment.

Following is a description of an image forming apparatus according to a first embodiment of the present invention. In this example, as one example of an image forming apparatus, among contact development-type image forming apparatus in which an electrophotographic system is adopted, an inline-type 4-drum full-color image forming apparatus employing an intermediate transfer belt is used. FIG. 1 is a schematic cross-sectional view that shows the general configuration of this sort of image forming apparatus.

Configuration of Image Forming Apparatus

As shown in FIG. 1, a 4-drum full-color image forming apparatus 1 has a configuration in which process cartridges PY, PM, PC, and PK of the four colors yellow, magenta, cyan, and black are removable from an image forming apparatus main body (referred to below as an apparatus main body) 2. The process cartridges PY, PM, PC, and PK (below, collectively referred to as P) constitute image forming stations (also referred to as image forming units) of respective color components that have been respectively installed in the apparatus main body. The image forming stations also include development units 63, photosensitive drums 61, and so forth, described later. Also provided in the apparatus main body 2 are an intermediate transfer belt unit 5 having an intermediate transfer belt 51 serving as an intermediate transfer member (rotating member), and a fixing unit 7 that thermally fixes toner. The image forming stations are disposed in series in the recording medium conveyance direction.

The process cartridges P respectively have photosensitive drums 61Y, 61M, 61C, and 61K, which are image carriers (photosensitive bodies), and are disposed sequentially in parallel in the movement direction of the intermediate transfer belt 51, onto which transfer is performed. On the image carrier, that is, on the surface of the image carrier, an electrostatic latent image is formed and developed using toner. Furthermore, each of the process cartridges P integrally has, around the circumference of the respective photosensitive drum 61, a primary charging unit 62 as a charging means, a development unit 63 as a development means, and a photosensitive member cleaner 65 as a cleaning means.

In each process cartridge P, the primary charging unit 62 is disposed on the outer circumferential surface of the photosensitive drum 61, and uniformly charges the surface of the photosensitive drum 61. The development unit 63 uses toner of the corresponding color (yellow, magenta, cyan, black) to develop the electrostatic latent image formed on the surface of the photosensitive drum 61 by exposure from respective laser exposure units (exposing means) 21Y, 21M, 21C, and 21K. A development roller 64 serving as a developer carrier within the development unit 63 is configured such that it is possible to prevent degradation of toner by, in each development unit 63, separating the development roller 64 from the photosensitive drum 61 and stopping rotation of the development roller 64. That is, in each development unit 63, the development roller 64 is configured so as to be capable of contact against or separation from the photosensitive drum 61. In the description below, a contacted state may also be referred to simply as contact, and a separated state may also be referred to simply as separation. Also, the position where the development roller contacts on the photosensitive drum is referred to as the contact position. After toner images have been sequentially transferred, the photosensitive member cleaner 65 removes toner remaining after transfer that is affixed to the surface of the photosensitive drum 61.

Also, a primary transfer roller 52 that together with the photosensitive drum 61 forms a primary transfer unit is disposed opposing the photosensitive drum 61 at a position where the primary transfer roller 52 together with the photosensitive drum 61 sandwiches the intermediate transfer belt 51.

On the other hand, the intermediate transfer belt unit 5 is provided with the intermediate transfer belt 51, and three rollers across which the intermediate transfer belt 51 is stretched: a drive roller 53, a tension roller 54, and a secondary transfer opposing roller 55. The intermediate transfer belt 51 is rotationally conveyed by rotationally moving the drive roller 53 with a belt drive motor (not shown). The tension roller 54 is configured so as to be movable in the horizontal direction in FIG. 1 according to the length of the intermediate transfer belt 51.

Near the drive roller 53, a registration detection sensor 56 serving as a detection means for detecting a toner patch on the intermediate transfer belt 51 is disposed near both ends in the roller longitudinal direction. This position is a predetermined detection position. A belt cleaner 58 for collecting remaining toner on the intermediate transfer belt is disposed near the tension roller 54. The longitudinal direction is the roller axial direction, and is the width direction orthogonal to the conveyance direction of the intermediate transfer belt 51. Furthermore, a secondary transfer roller 82 that together with the secondary transfer opposing roller 55 forms a secondary transfer unit is disposed opposing the secondary transfer opposing roller 55 at a position where the secondary transfer opposing roller 55 sandwiches the intermediate transfer belt 51. The secondary transfer roller 82 is held by a transfer/conveyance unit 8.

A feed unit 3 that feeds a recording medium (in this apparatus, a print medium such as paper) Q to the secondary transfer unit is disposed in the lower portion of the apparatus main body 2. The feed unit 3 is provided with a cassette 31 in which a plurality of sheets of the recording medium Q are stored, a feed roller 32, a retarding roller pair 33 that prevents double feeding, conveying roller pairs 34 and 35, a registration roller pair 36, and so forth. Discharge roller pairs 37, 38, and 39 are provided in the conveyance path on the downstream side of the fixing unit 7.

The color image forming apparatus 1 is compatible with duplex printing, and after image forming on a first face of a recording medium Q is finished and that recording medium Q is discharged from the fixing unit 7, by switching a switching member 41, the recording medium Q is conveyed to the side of reversing roller pairs 42 and 43. Once the trailing edge of this recording medium Q has passed over a switching member 44, at the same time as switching the switching member 44, the reversing rollers 43 are rotated in reverse to guide the recording medium Q to a duplex conveyance path 45. Then, by rotationally driving duplex conveyance path roller pairs 46, 47, and 48 to again feed the recording medium Q, printing to a second face is made possible.

Furthermore, an image forming control unit (also referred to as simply a control unit) 12 is provided in the image forming apparatus 1, and with this image forming control unit 12, output signals of respective sensors are obtained, and image forming operations such as the timing of driving of the drive unit and the timing of latent image formation and so forth are controlled.

Configuration of Control Unit

Figure 2:
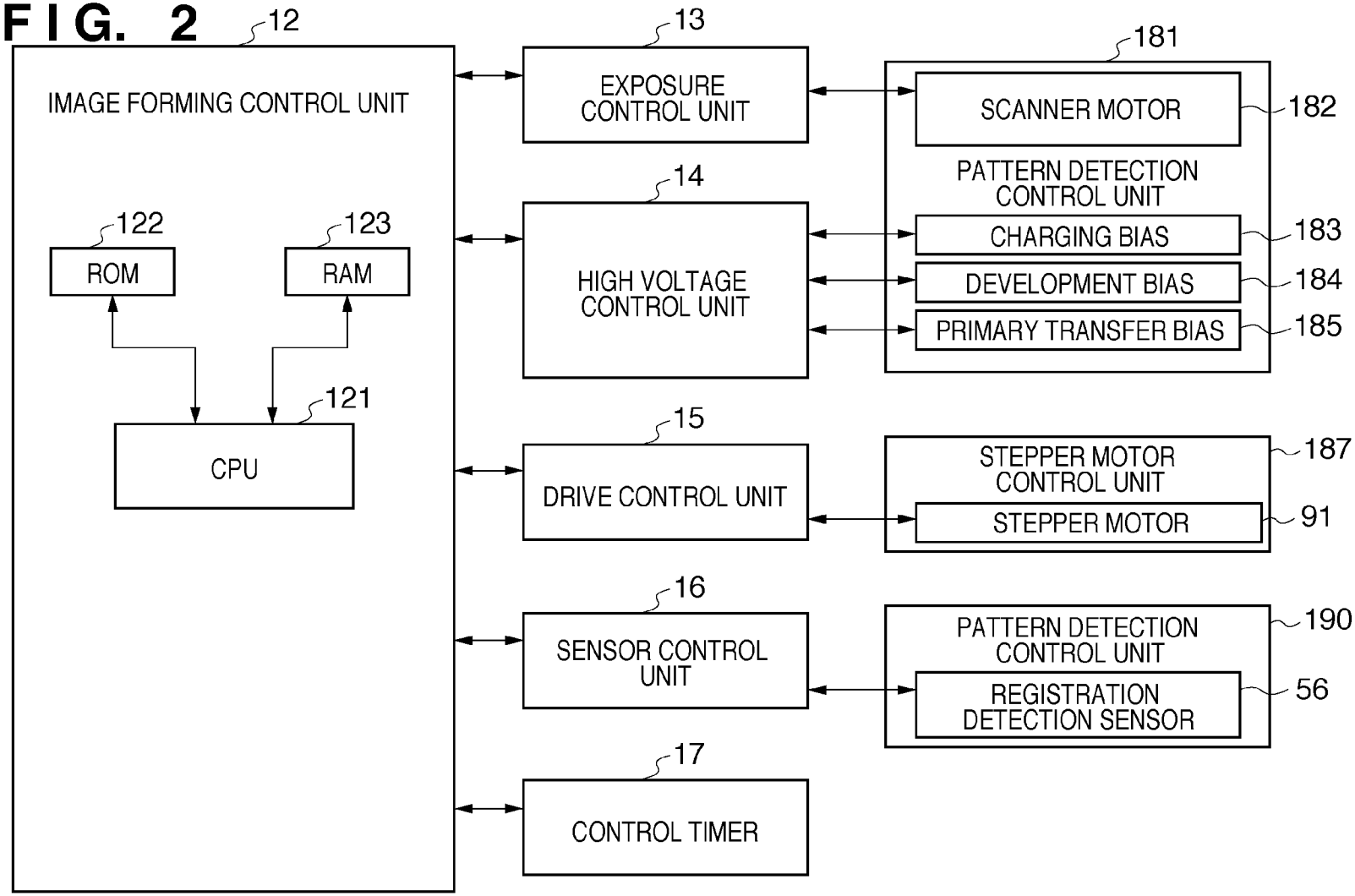
FIG. 2 is a function block diagram of a printer according to an embodiment.

Next is a detailed description of the configuration of the image forming control unit 12 disclosed in the first embodiment of the present invention, with reference to FIG. 2. The image forming control unit 12 includes a CPU 121 that is a processor that executes a program to execute data processing and input/output processing, and a ROM 122 and a RAM 123 that store data, programs, and so forth. With this configuration, a timer and respective control units that have been mapped to a memory space or IO space, for example, are controlled. As control units, for example, there are an exposure control unit 13, a high voltage control unit 14, a drive control unit 15, a sensor control unit 16, and so forth. Additionally, a control timer 17 also is used for time measurement and the like. The exposure control unit 13, in addition to driving the laser exposure unit 21, drives a scanner motor 182, performs correction of a laser light amount, and so forth. The high voltage control unit 14 charges and applies a development bias to the photosensitive drum 61, applies a primary transfer bias to the intermediate transfer belt 51, applies a secondary transfer bias to the recording medium Q, applies a belt cleaning bias for the belt cleaner, and so forth, necessary for image forming. The drive control unit 15 drives a motor (not shown) of the image forming system of the photosensitive drum 61, the development roller 64, and the intermediate transfer belt 51, and drives a conveyance motor (not shown) that conveys the recording medium Q. The sensor control unit 16 performs detection of the amount of remaining toner and the position of the recording medium Q in the conveyance path. In addition, the sensor control unit 16 performs detection of a toner patch on the intermediate transfer belt 51 using the registration detection sensor 56, and detection of a position display mark provided on the intermediate transfer belt 51 using a mark sensor 57.

Following is a more detailed description of the above configuration. A pattern detection control unit 181 includes the scanner motor 182, a charging bias control unit 183, a development bias control unit 184, and a primary transfer bias control unit 185. The charging bias control unit 183 controls the bias applied to the primary charging unit 62. The development bias control unit 184 controls the bias of a charging unit for charging the development roller 64. The primary transfer bias control unit 185 controls a charging unit that applies a positive bias to the primary transfer roller 52 when image forming is performed, and applies a negative bias when collecting waste toner. Of course, it is also conceivable that the respective bias control units themselves include a charging unit.

Figure 3A:
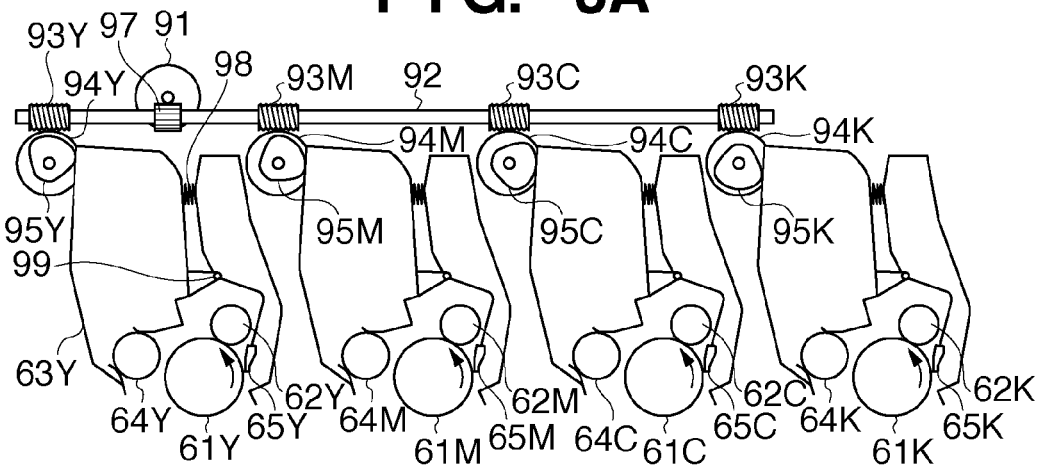
FIGS. 3A to 3C show example contact/separation states of a photosensitive drum and a development roller of an inline-type full-color printer according to an embodiment.
Figure 3B:
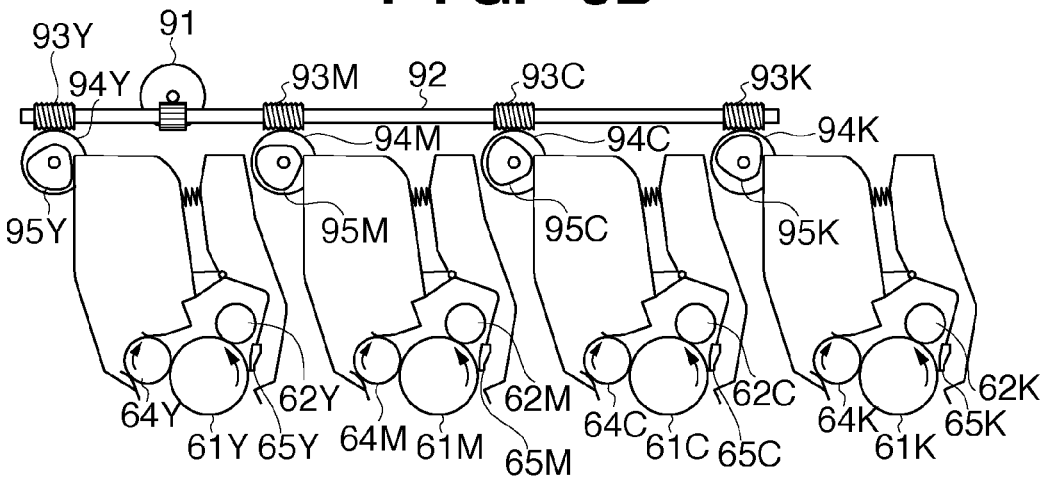
Figure 3C:
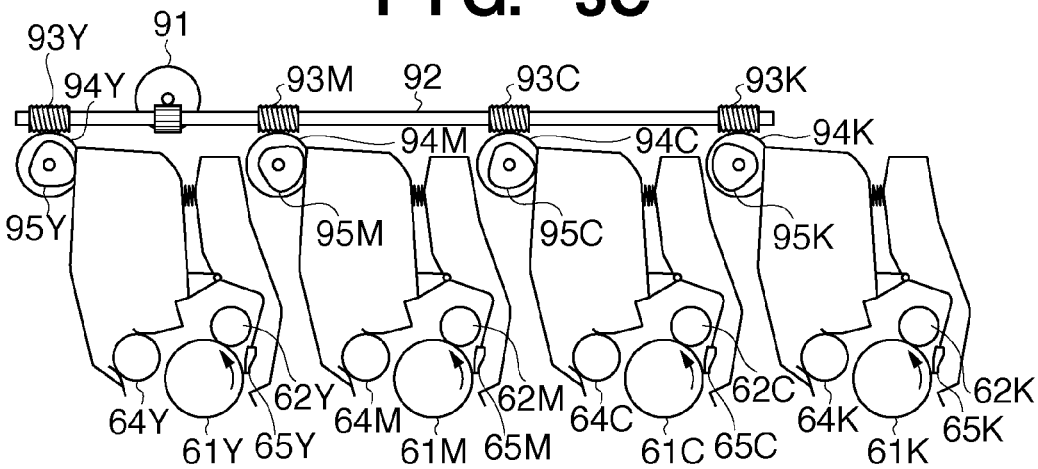

A stepper motor control unit 187 controls a stepper motor 91, the gist of which is shown by way of example in FIGS. 3A to 3C. This will be described in detail below with reference to FIGS. 3A to 3C, but in the present embodiment, the stepper motor 91 is a motor that drives a worm gear that engages with a worm wheel that has been fixed coaxially to a cam for moving the position of the development roller 64 of each color component. In order for the worm gears that drive the respective cams to be coaxially fixed and simultaneously driven by the single stepper motor 91, the phase difference of the respective cams is fixed. By driving the stepper motor 91 at a timing corresponding to image forming of each color component, the development roller 64 is separated from or contacted against the photosensitive drum 61.

Figure 10:
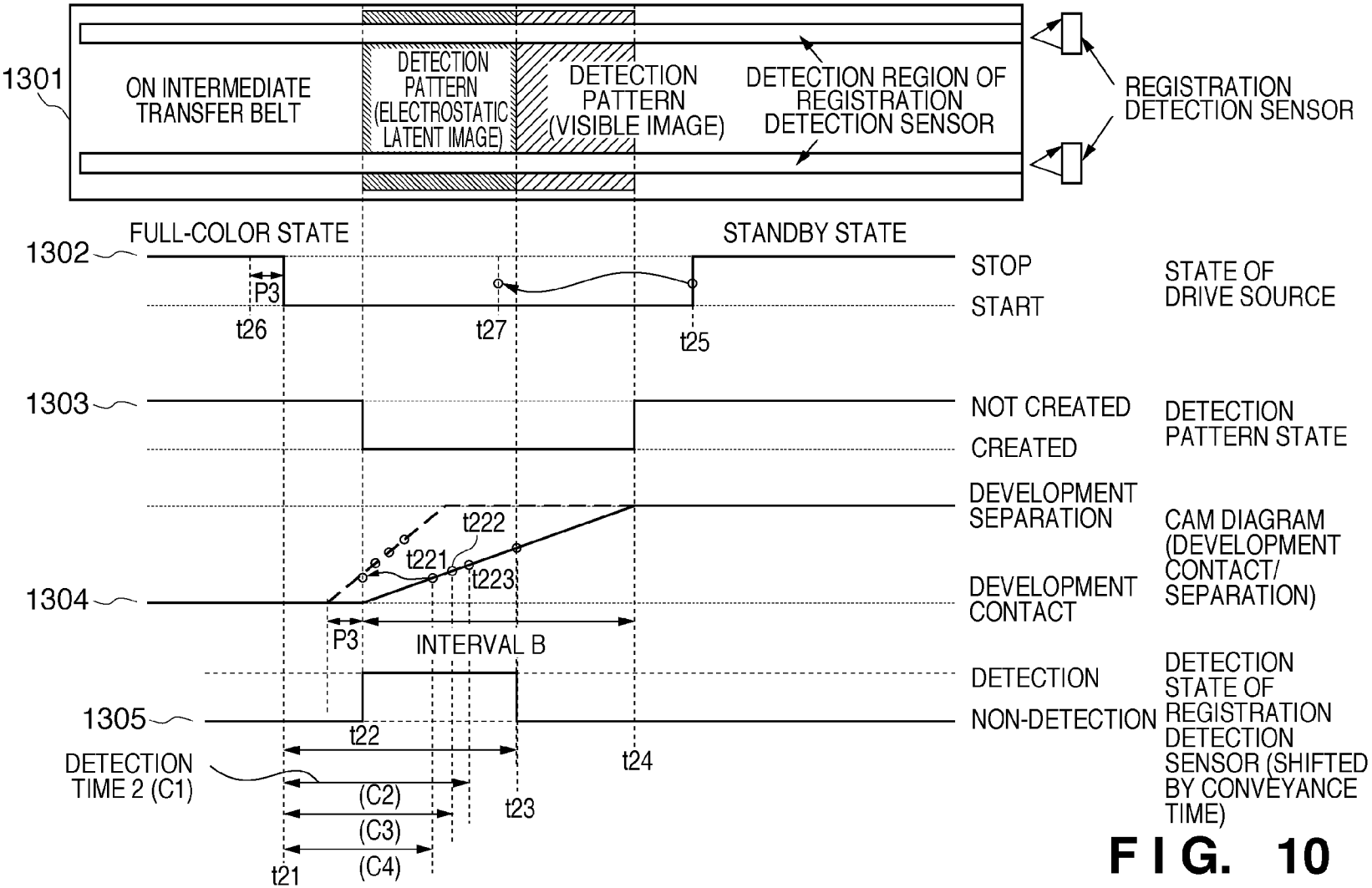
FIG. 10 is a diagram that shows detection states when detecting timing of separation of the photosensitive drum and the development roller in the first embodiment.

A registration detection sensor 56 (in this embodiment, two sensors 56*a* and 56*b*) of the sensor control unit 16 shown in FIG. 10 is controlled by the pattern detection control unit 181. In the pattern detection control unit 181, a time from starting of the stepper motor 91 until a detection pattern passes directly below the registration detection sensor 56 is measured with the control timer 17. Also, the pattern detection control unit 181 performs switching control of a detection window for determining the image forming station that formed the detection pattern that passed directly below the registration detection sensor 56. The timing of starting of the stepper motor 91 can be known from a notification made via the image forming control unit 12, for example. It is also possible for the detection pattern to be a correction image used for correcting timing.

Operation of Image Forming Apparatus

Here, an image forming operation of the 4-drum full-color image forming apparatus 1 configured in the above manner will be described. When the image forming operation is started, first, after the recording medium Q in the cassette 31 has been fed by the feed roller 32, the recording medium Q is separated into individual sheets by the retard roller pair 33, and then conveyed to the registration roller pair 36 via the conveying roller pairs 34 and 35 and so forth.

On the other hand, parallel with the conveyance operation of the recording medium Q, for example in the yellow process cartridge PY, first the surface of the photosensitive drum 61Y is uniformly negatively charged by the primary charging unit 62, and then image exposure is performed by the laser exposure unit 21Y. Thus, an electrostatic latent image corresponding to a yellow image component of an image signal is formed on the surface of the photosensitive drum 61Y.

The development roller 64Y in the development unit 63Y, while being rotationally driven, is gradually moved, and approaches and contacts against the photosensitive drum 61Y, and thus the electrostatic latent image of the photosensitive drum 61Y is developed using the yellow toner negatively charged by the development unit 63Y. Thus, the electrostatic latent image is made visible as a yellow toner image. That is, the electrostatic latent image becomes a visible image and appears. Primary transfer of the yellow toner image obtained in this manner onto the intermediate transfer belt 51 is performed by the primary transfer roller 52, which has been supplied with a primary transfer bias.

This sort of one iteration of a toner image forming operation is also sequentially performed in the other process cartridges PM, PC, and PK, at staggered times corresponding to the interval and conveyance speed of those process cartridges. The development roller 64, while rotating, sequentially contacts against the photosensitive drum 61 in order to prevent degradation of developer. Then, primary transfer is performed with the toner images of each color that have been formed on the respective photosensitive drums 61 sequentially overlaid in the primary transfer unit of each color in a corresponding region on the intermediate transfer belt 51 (referred to as the image forming region on the intermediate transfer belt 51). When the development operation is finished, the development rollers 64 are sequentially separated from the photosensitive drums 61 and rotation is stopped in order to prevent degradation of developer, even if primary transfer is currently being performed by a process cartridge on the downstream side. The toner images in four colors that have thus been transferred onto the intermediate transfer belt 51 in a stacked manner are moved to the secondary transfer unit as the intermediate transfer belt 51 rotates.

On the other hand, the recording medium Q, after oblique travel thereof has been corrected at the registration roller pair 36, is fed out to the secondary transfer unit at a timing coordinated with the toner images on the intermediate transfer belt 51. Secondary transfer of the toner images in four colors on the intermediate transfer belt 51 is collectively performed onto the recording medium Q by the secondary transfer roller 82 contacted against the intermediate transfer belt 51 so as to sandwich the recording medium Q. The recording medium Q to which a toner image has been thus transferred is then conveyed to the fixing unit 7, and after the toner image has been fixed by applying heat and pressure to the recording medium Q, the recording medium Q is discharged to and stacked on the upper face of the apparatus main body by the discharge roller pairs 37, 38, and 39. By the above process, a full-color toner image is formed on a recording medium.

Operation Switching Contact and Separation of Photosensitive Drum and Development Roller Next is a description of the mechanism that switches contact and separation of the development roller 64 and the photosensitive drum 61, with reference to FIGS. 3A to 3C. A worm gear 97 is fixed to an output shaft of the stepper motor 91, which is the drive source for switching between contact and separation of the development roller 64, and the stepper motor 91 rotates a drive switching shaft 92, to which a pinion gear that engages with the worm gear is coaxially fixed. A worm gear 93 for driving cam gears 94 of each color is fixed to the drive switching shaft 92, and when the drive switching shaft 92 rotates, the phase of a cam 95 fixed coaxially to the cam gear 94 changes. The cam 95 is a plate cam whose circumferential edge is formed such that the radius from the center of rotation differs depending on the phase. The circumferential edge of the cam 95 applies pressure against a side face of the process cartridge P or releases pressure according to the phase of the cam 95. The side face of the process cartridge P serving as a cam follower is a side face of the case of the development unit 63 that axially supports the development roller, and the case of the development unit 63, is axially supported near its center by a shaft 99 parallel to the photosensitive drum 61 or the like, to the case supporting the photosensitive drum. The case where the photosensitive drum 61 is axially supported is fixed to the apparatus main body 2, and between that case and the case of the development unit 63, an elastic member 98 such as a spring for energizing the case of the development unit 63 to the cam 95 is provided. Thus, the development roller 64 swings, centered on the shaft 99, according to movement of the case of the development unit 63, which is driven by the cam 95. Thus, the development roller 64 contacts against or separates from the photosensitive drum 61 according to the phase of the cam 95. Note that because the minimum distance between the development roller 64 and the photosensitive drum 61 is 0, the amount of swinging movement of the case of the development unit 63 is regulated not only by the radius of the cam 95, but also by the photosensitive drum 61. Thus it is possible to switch between contact and separation of the photosensitive drum 61 and the development roller 64.

The contact and separation states of the development roller 64 and the photosensitive drum 61 in the present embodiment include a standby state (or complete separation state) shown in FIG. 3A, a full-color contact state shown in FIG. 3B, and a monochrome contact state shown in FIG. 3C. In the standby state, all of the cams 95 (95Y, 95M, 95C, and 95K) are contacted against the side face of the process cartridges P (PY, PM, PC, and PK) at the maximum radius, and all of the development rollers 64 (64Y, 64M, 64C, and 64K) are separated from the photosensitive drums 61 (61Y, 61M, 61C, and 61K). The maximum radius is a radius as necessary in order to separate the development roller 64 from the photosensitive drum 61. In the full-color contact state, all of the cams 95 (95Y, 95M, 95C, and 95K) are contacted against (or separated from) the side face of the process cartridges P (PY, PM, PC, and PK) at approximately a minimum radius. The minimum radius is a radius as necessary for contact of the development roller 64 and the photosensitive drum 61. As a result, all of the development rollers 64 (64Y, 64M, 64C, and 64K) are contacted against all of the photosensitive drums 61 (61Y, 61M, 61C, and 61K). In the monochrome contact state, the cams 95 (95Y, 95M, and 95C) of the three colors yellow (Y), magenta (M), and cyan (C) shown in FIG. 3C are contacted against the side face of the process cartridges P (PY, PM, and PC) of the three colors yellow (Y), magenta (M), and cyan (C). Only the cam 95K for black (K) is separated from (or contacted against at approximately the minimum radius) the side face of the process cartridge PK, and only the black development roller 64K is contacted against the photosensitive drum 61K.

Figure 4:
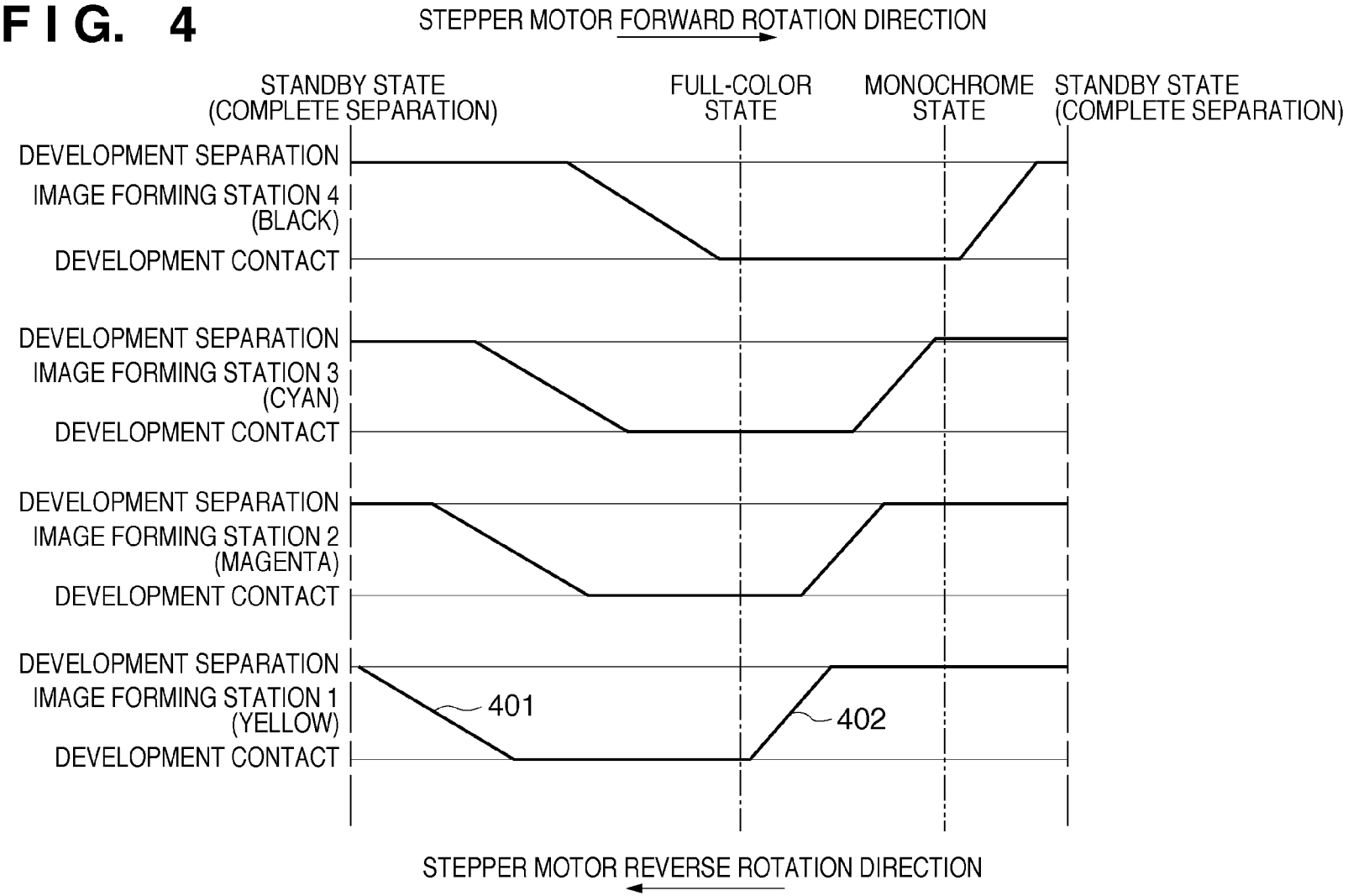
FIG. 4 is a cam diagram of a driving cam for causing a development roller of an inline-type full-color printer according to an embodiment to contact with/separate from a photosensitive drum.

Next, the relationship between phase changes of the cam 95 and the three selectable states is shown in cam diagrams in FIG. 4. In FIG. 4, development separation is the side where the development roller 64 and the photosensitive drum 61 separate, and the cam radius is large, and development contact is the side where the development roller 64 and the photosensitive drum 61 are contacted, and the cam radius is small. FIG. 4 only shows cam profiles, and does not show actual contact and separation of the development roller 64 and the photosensitive drum 61. As shown in FIG. 4, each of the cams 95 (95Y, 95M, 95C, and 95K) have respective profiles, and by staggering the phases of each of the cams 95 (95Y, 95M, 95C, and 95K), switching (mode switching) between the three states shown in FIGS. 3A to 3C is possible. Note that in the description below, contact of the photosensitive drum 61 and the development roller 64 may be referred to simply as contact or development contact, and separation of the photosensitive drum 61 and the development roller 64 may be referred to simply as separation or development separation.

When performing an ordinary printing operation, the state of the development roller 64 is switched from the standby state to the full-color contact state, or from the standby state to the monochrome contact state, in coordination with the timing at which image forming is started. First, switching of the development contact/separation state in the case of performing full-color printing will be described. The development contact/separation state refers to the state of contact or separation of the development roller 64 and the photosensitive drum 61, where a state in which the development roller 64 and the photosensitive drum 61 are contacted is referred to as a development contact state (or contact state), and a state in which the development roller 64 and the photosensitive drum 61 are separated is referred to as a development separation state (separation state). The stepper motor 91 is stopped in the standby state. For example, the standby state can be determined for a specific cam by providing a sensor therein that indicates the rotational phase of that cam. Alternatively, the standby state can be determined by once determining the position of the standby state, then measuring the number of steps of one circumference of the cam, and driving the motor while counting the number of steps, or the like.

When performing full-color printing, the stepper motor 91 is rotationally driven forward by a predetermined number of steps in coordination with the timing at which image forming is started. When forward rotational driving of the stepper motor 91 is started, the development roller 64 and the photosensitive drum 61 of each image forming station pass through an indefinite state 401 and are contacted, thus establishing the full-color contact state. The order of that contact is image forming station 1→(yellow)→image forming station 2 (magenta)→image forming station 3 (cyan)→image forming station 4 (black). Image forming is started from the image forming station whose contact is completed. The number of driving steps of the stepper motor 91 at this time is a number of driving steps such that the stepper motor 91 stops in the full-color state with contact completed for all of the image forming stations. When image forming ends, the stepper motor 91 is again rotationally driven forward by a predetermined number of steps. When forward rotational driving of the stepper motor 91 is started, the development roller 64 and the photosensitive drum 61 pass through an indefinite state 402 and separate, thus returning to the standby state. The order of separation is image forming station 1→(yellow)→image forming station 2 (magenta)→image forming station 3 (cyan)→image forming station 4 (black). Thus image forming is ended. The number of driving steps of the stepper motor 91 at this time is a number of driving steps such that the cam stops in the standby state. That is, the above operation begins from the standby state, passes through stoppage in the full-color state, and returns to the standby state again.

Next is a description of switching control of the development contact/separation state when performing monochrome printing. When performing monochrome printing, the stepper motor 91 is rotationally driven in reverse by a predetermined number of steps in coordination with the timing at which image forming is started. When reverse rotational driving of the stepper motor 91 is started, the development roller 64 and the photosensitive drum 61 pass through an indefinite state and are contacted only in the image forming station 4 (black), and image forming in the image forming station 4 (black) is started. The number of driving steps of the stepper motor 91 is a number of driving steps such that the stepper motor 91 stops when contact is completed in only the image forming station 4 (black). When image forming ends, the stepper motor 91 is rotationally driven forward by a predetermined number of steps. When forward rotational driving of the stepper motor 91 is started, the development roller 64K and the photosensitive drum 61K of the station 4 (black) separate and printing is ended. The number of driving steps of the stepper motor 91 at this time is a number of driving steps so as to stop when separation of all of the image forming stations is completed.

The image forming apparatus 1, in the process of image forming, switches the development contact/separation state of the development roller 64 and the photosensitive drum 61 from the separation state to the contact state, or from the contact state to the separation state. At that time, the drive start timing (start time) and number of steps of the stepper motor 91 in the standby state, and the drive start timing and number of steps of the stepper motor 91 in the full-color contact state, are predetermined.

Here, contact of the development roller 64 and the photosensitive drum 61 is not necessarily started when in the contact state shown in FIG. 4. Contact of the development roller 64 and the photosensitive drum 61 may occur before the minimum radius portion of the cam 95 contacts against the case of the development unit, depending on variation in the distance between the cam 95 and the process cartridge provided in the apparatus main body 2. In this way, variation in the contact timing and the separation timing occurs due to the effects of individual differences between components, installation precision, and so forth. Consequently, in the present embodiment, the contact timing is detected, and the cam drive timing and rotational speed are adjusted such that the development roller 64 and the photosensitive drum 61 contact at nearly an optimal timing. Therefore, next is a description of the principles of a method for detecting the timing of contact of the development roller 64 against the photosensitive drum 61 or the timing of separation.

Principles of Detecting Development Contact Timing and Development Separation Timing First, the principles of a method for detecting the timing of contact of the development roller 64 against the photosensitive drum 61 will be described with reference to FIGS. 5 and 6. The contact timing (development contact timing) can be specified with the time from starting the stepper motor 91 until completion of contact of the development roller 64 against the photosensitive drum 61. This time is referred to as a development contact completion passed time, or simply as the movement time of the development roller 64. In each image forming station, when the stepper motor 91 is started, by this driving the development rollers 64 are sequentially contacted against the photosensitive drums 61, and thus the development contact/separation state changes from the separation state to the contact state.

Figure 5:
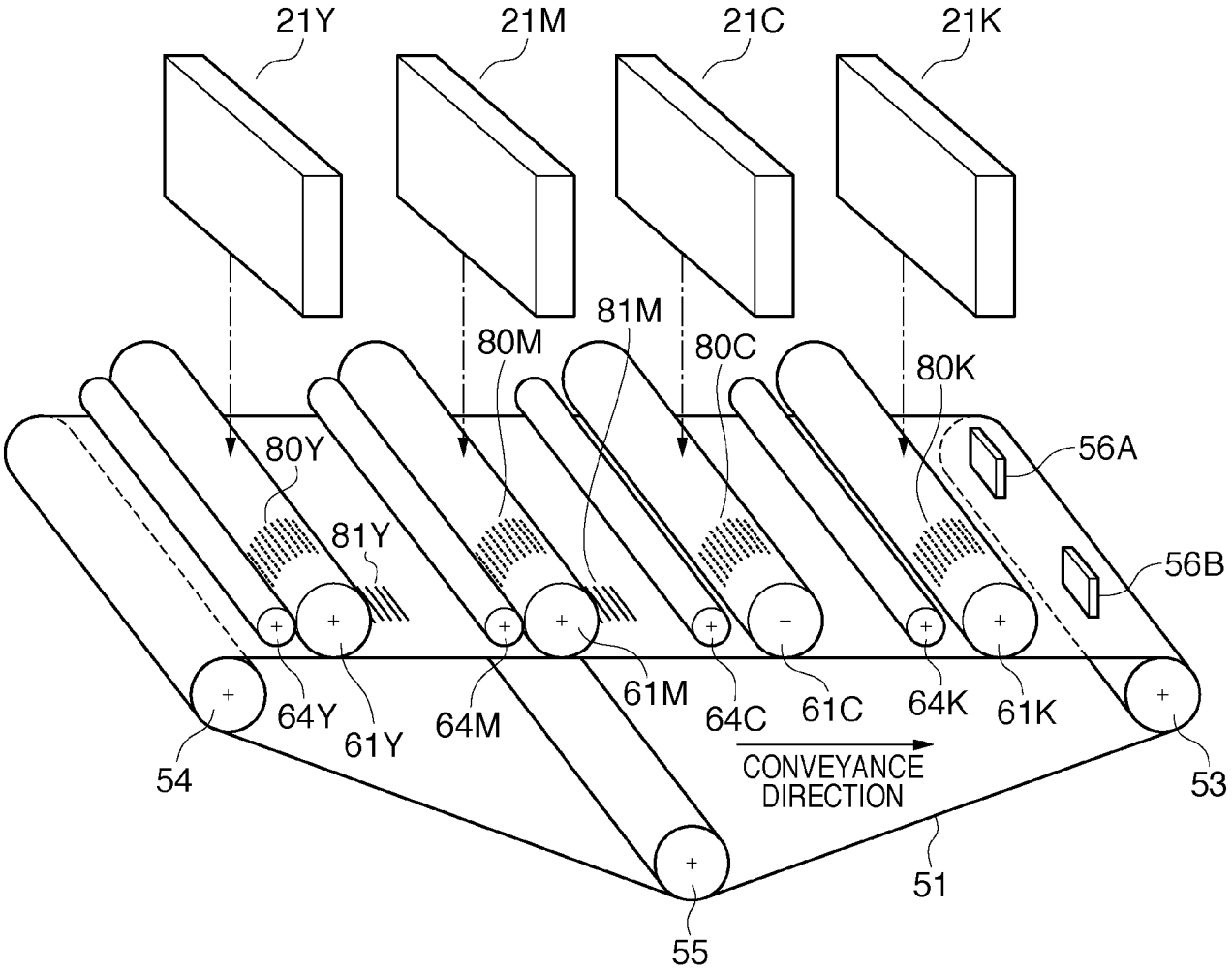
FIG. 5 is a perspective view of an image forming unit of an inline-type full-color printer according to an embodiment.
Figure 6:
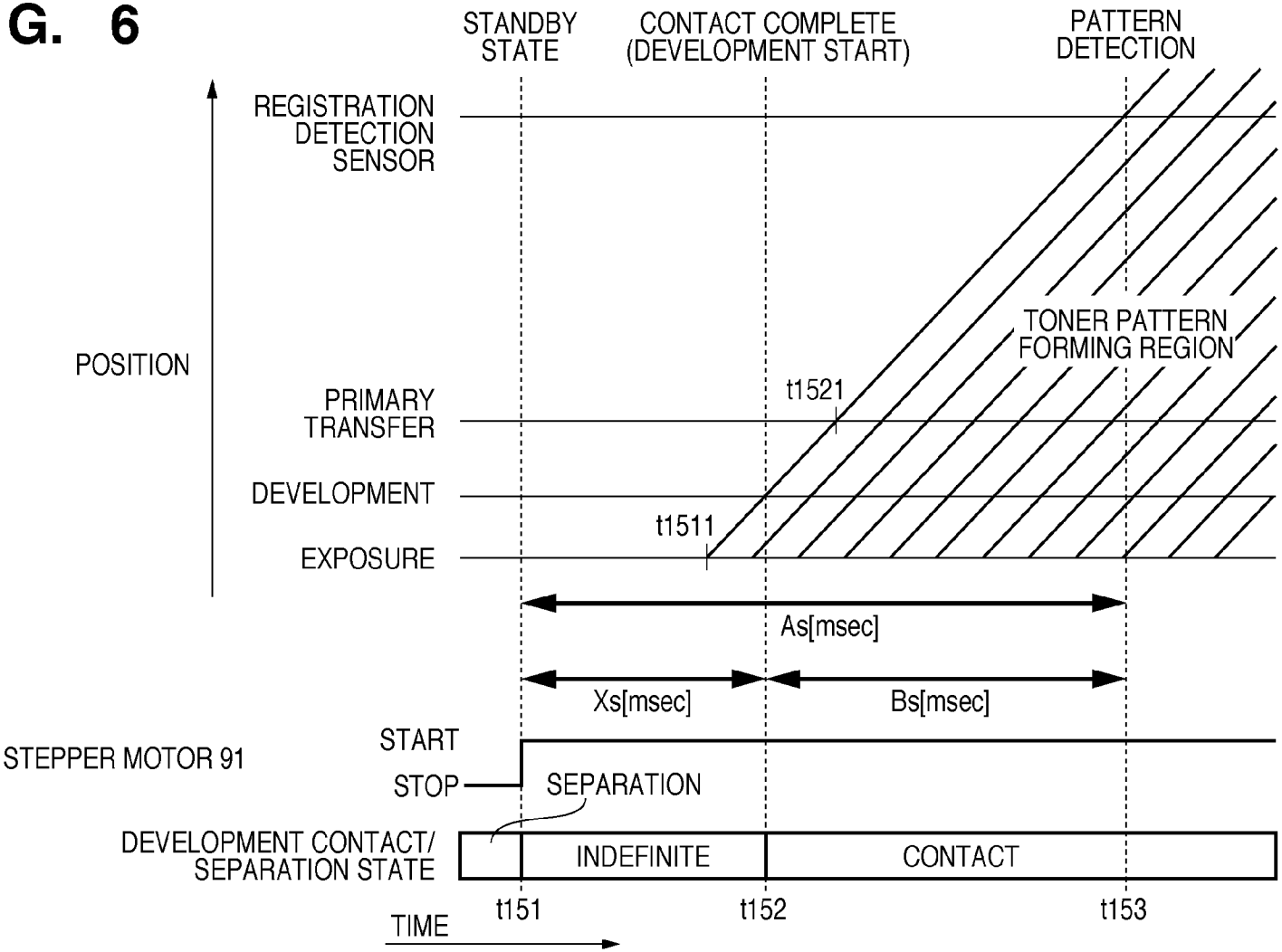
FIG. 6 is a diagram of detection times of timing of contact of a photosensitive drum and a development roller of an inline-type full-color printer according to an embodiment.

While the state is transitioning, that is, while the state is indefinite, as shown in FIG. 5, an electrostatic latent image 80 is formed on the surface of the photosensitive drum 61 by exposure from the respective laser exposure units (exposing means) 21Y, 21M, 21C, and 21K. Also, latent image formation is not only performed during the indefinite state, rather, latent image formation is performed such that a continuous latent image in the rotational direction of the photosensitive drum 61 is developed beginning from an intermediate point of the image. In an image forming station where contact of the development roller 64 has been completed, toner is supplied from the development roller 64 to the electrostatic latent image 80 on the drum surface, so that a toner image is formed on the drum surface. The formed toner image is transferred to the intermediate transfer belt 51, and a detection pattern 81, which is a detection image, of each color is formed on the intermediate transfer belt 51. The development contact timing is calculated from the passed time (development contact completion passed time) As(msec) from starting of the stepper motor 91 until detection of the detection pattern 81 formed on the intermediate transfer belt 51 by the registration detection sensor 56. However, when there are a plurality of image forming stations, the development contact completion passed time will differ for each image forming station depending also on cam phase offset. This is because even in the standby state, which is the state in which measurement is started, there is a phase difference in cams between stations. Therefore, the difference in movement times between respective stations due to phase offset is compensated. The time of movement due to phase offset can be determined by the predetermined phase relationship between stations and the drive speed of the stepper motor 91. For example, where the phase of each cam is delayed by an angle $\alpha$ in the order that the image forming stations are disposed, and the cam drive angular velocity (uniquely determined from motor drive speed) is Vc, for each subsequent station, $\alpha$/Vc is subtracted from the measured development contact completion passed time. For example, the phase difference is compensated by subtracting 0 from the measured time of the station 1, subtracting $\alpha$/Vc from the measured time of the station 2, subtracting 2$\alpha$/Vc from the measured time of the station 3, and subtracting 3$\alpha$/Vc from the measured time of the station 4. In the description hereafter, with respect to the times As and Cs (described below), the phase difference between stations has been compensated. Note that here, an example is described in which the detection pattern 81 is formed on the intermediate transfer belt 51 and detected with the registration detection sensor 56, but the detection pattern 81 is not limited to being formed on the intermediate transfer belt 51, and may for example be formed on a recording medium conveyance belt or the like.

Here, the method for calculating the development contact timing will be described with reference to the diagram shown in FIG. 6. FIG. 6 shows toner image states up until a toner image that has been formed by the development roller 64 contacting against the photosensitive drum 61 passes by the registration detection sensor 56. Time is shown on the horizontal axis, and the distance along a path from formation of an electrostatic latent image until a toner image arrives at the position of the registration detection sensor 56 is shown on the vertical axis. The stepper motor 91 is started from the standby state at a timing t151, and the development roller 64 contacts against the photosensitive drum 61 at a timing t152 after passage of a development contact time Xs(msec). The stepper motor 91 stops in the full-color contact state after rotating by the number of steps described above. Latent image formation on the photosensitive drum 61 is started from a timing t1511, and that latent image is developed from the timing t152. The developed toner image moves to a transfer position with rotation of the photosensitive drum 61, and primary transfer of that toner image to the intermediate transfer belt 51 is performed at a timing t1521. With conveyance of the intermediate transfer belt 51, the toner image passes by the registration detection sensor 56, and there the toner image, that is, the detection pattern 81, is detected.

When considering the relationship of measurement times, the calculated development contact time Xs is the difference between the development contact completion passed time As and a passed time Bs from development of the toner image formed on the surface of the photosensitive drum 61 until the toner image is detected by the registration detection sensor 56. That is, the development contact time Xs can be calculated from formula (1). Here, the suffix s indicates an image forming station, and for example, the development contact completion passed time for the image forming station 1 is A1 (hereinafter, S means image forming station).

$$Xs=As-Bs(\text{msec}) \quad (1)$$

The time As can be measured by the control timer 17. The time Bs is the time needed for the developed toner image to move from the development position on the photosensitive drum 61 to the position of the registration detection sensor 56, and is a constant provided by the conveyance speed and conveyance distance of the toner image.

Next is a description of principles of a method for detecting the timing of separation of the development roller 64 from the photosensitive drum 61. The development separation timing can be specified with the time from starting the stepper motor 91 in the full-color contact state until completion of separation of the development roller 64 from the photosensitive drum 61. This time is referred to as the development separation completion passed time. In the respective image forming stations, when the stepper motor 91 is started, the development rollers 64 are sequentially separated from the photosensitive drums 61, so that the development contact/separation state is switched to the separation state. The development separation timing is calculated from a development separation completion passed time Cs(msec) from starting of the stepper motor 91 until the detection pattern 81 formed on the intermediate transfer belt 51 can no longer be detected by the registration detection sensor 56.

Figure 7:
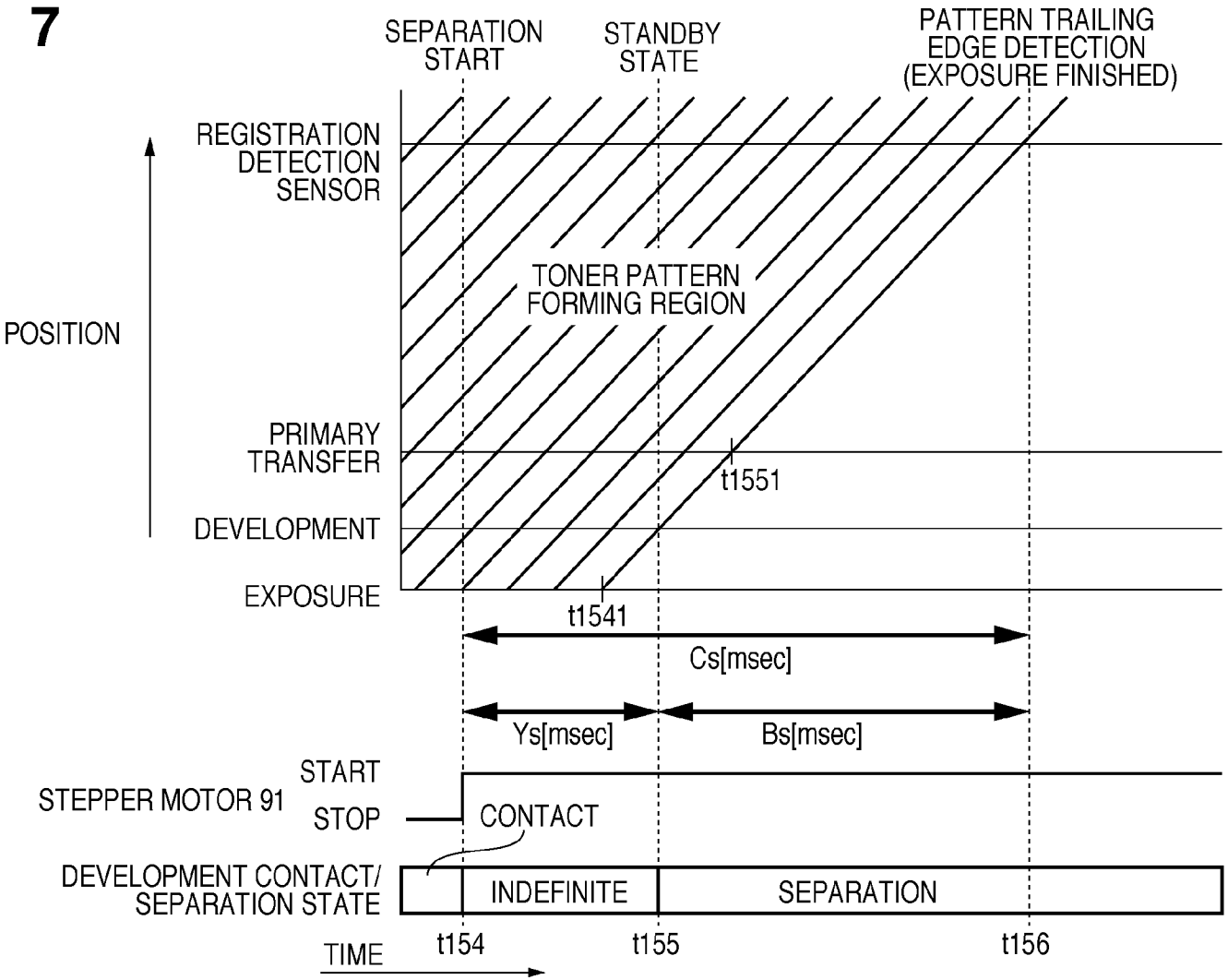
FIG. 7 is a diagram of detection times of timing of separation of a photosensitive drum and a development roller of an inline-type full-color printer according to an embodiment.

Here, the method for calculating the development separation timing will be described with reference to the diagram shown in FIG. 7. FIG. 7 shows toner image states up until a toner image that has been no longer formed due to the development roller 64 separating from the photosensitive drum 61 passes by the registration detection sensor 56. Time is shown on the horizontal axis, and the distance along a path from formation of an electrostatic latent image until a toner image arrives at the position of the registration detection sensor 56 is shown on the vertical axis. The stepper motor 91 is started at a timing t154, and arrives at the standby state at a timing t155. At a timing t1541 therebetween, the development roller 64 and the photosensitive drum 61 separate. Primary transfer of the trailing edge of the toner image formed immediately before separation to the intermediate transfer belt 51, is performed at a timing t1551, and the toner image is conveyed and arrives at the position of the registration detection sensor 56 at a timing t156. A development separation time Ys(msec) is the difference between the above-described development separation completion passed time Cs(msec) and the fixed time Bs(msec), and can be calculated from formula (2).

$$Ys=Cs-Bs(\text{msec}) \quad (2)$$

Ordinarily, when detecting the development contact timing and the development separation timing of the development rollers 64 to the photosensitive drums 61 of all of the image forming stations, the development contact timing or the development separation timing of all four image forming stations is detected with a single registration detection sensor 56. Therefore, in the present embodiment, it is necessary to perform four development contact operations and four development separation operations for each of the colors.

Figure 8:
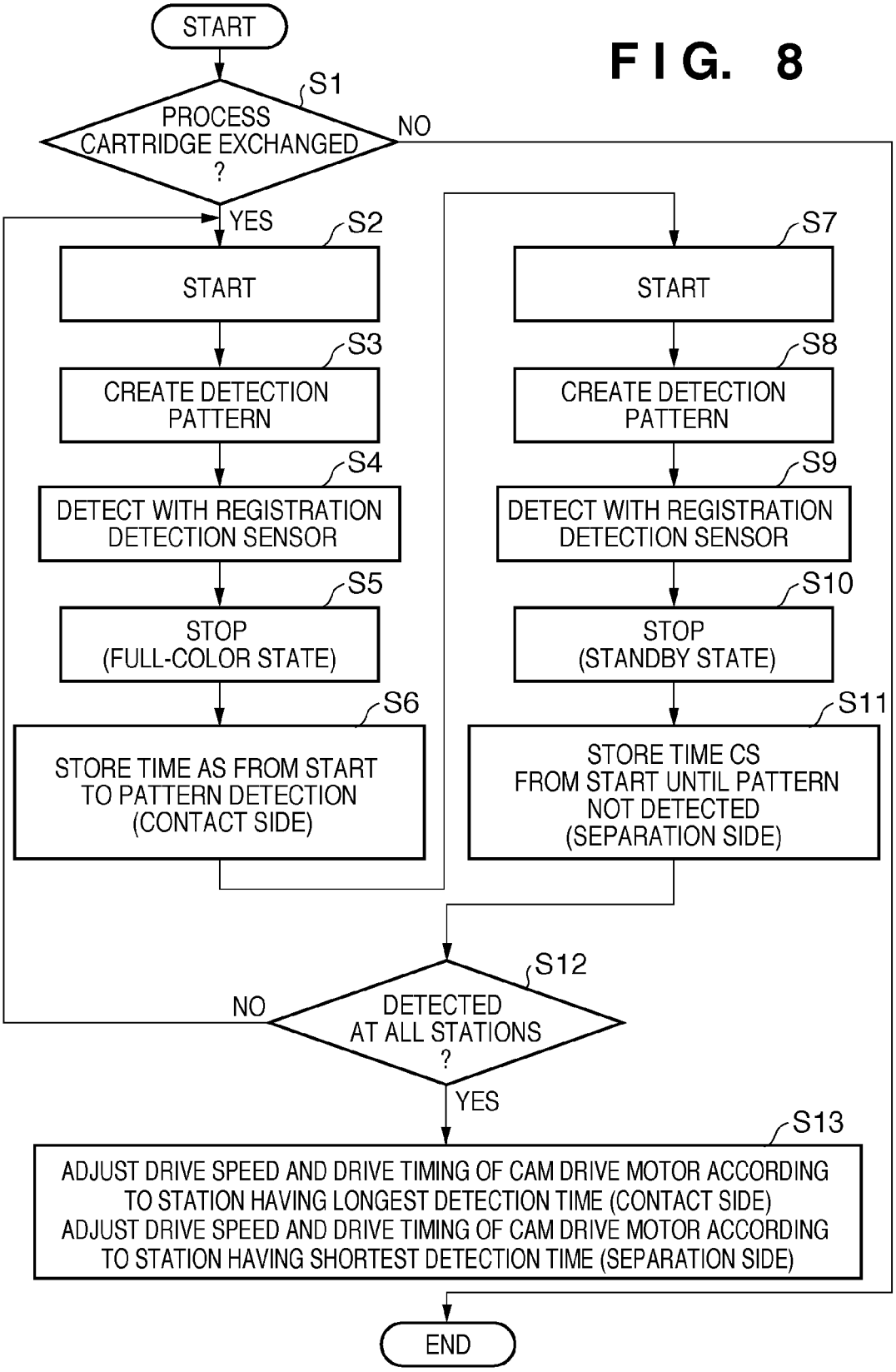
FIG. 8 is a flow diagram of a control program that detects timing of contact/separation of a photosensitive drum and a development roller in a first embodiment.
Figure 9:
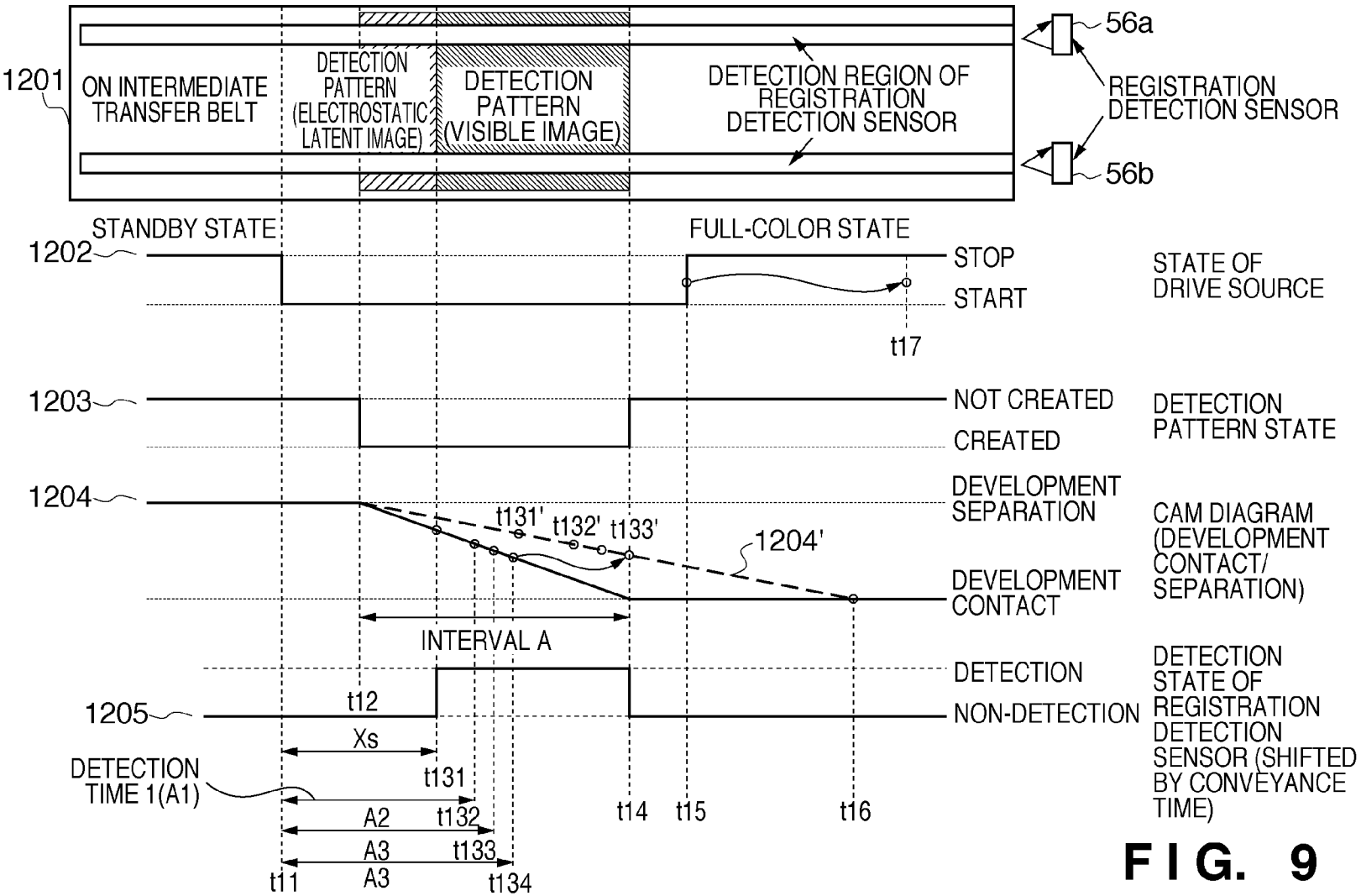
FIG. 9 is a diagram that shows detection states when detecting timing of contact of the photosensitive drum and the development roller in the first embodiment.
Figure 11:
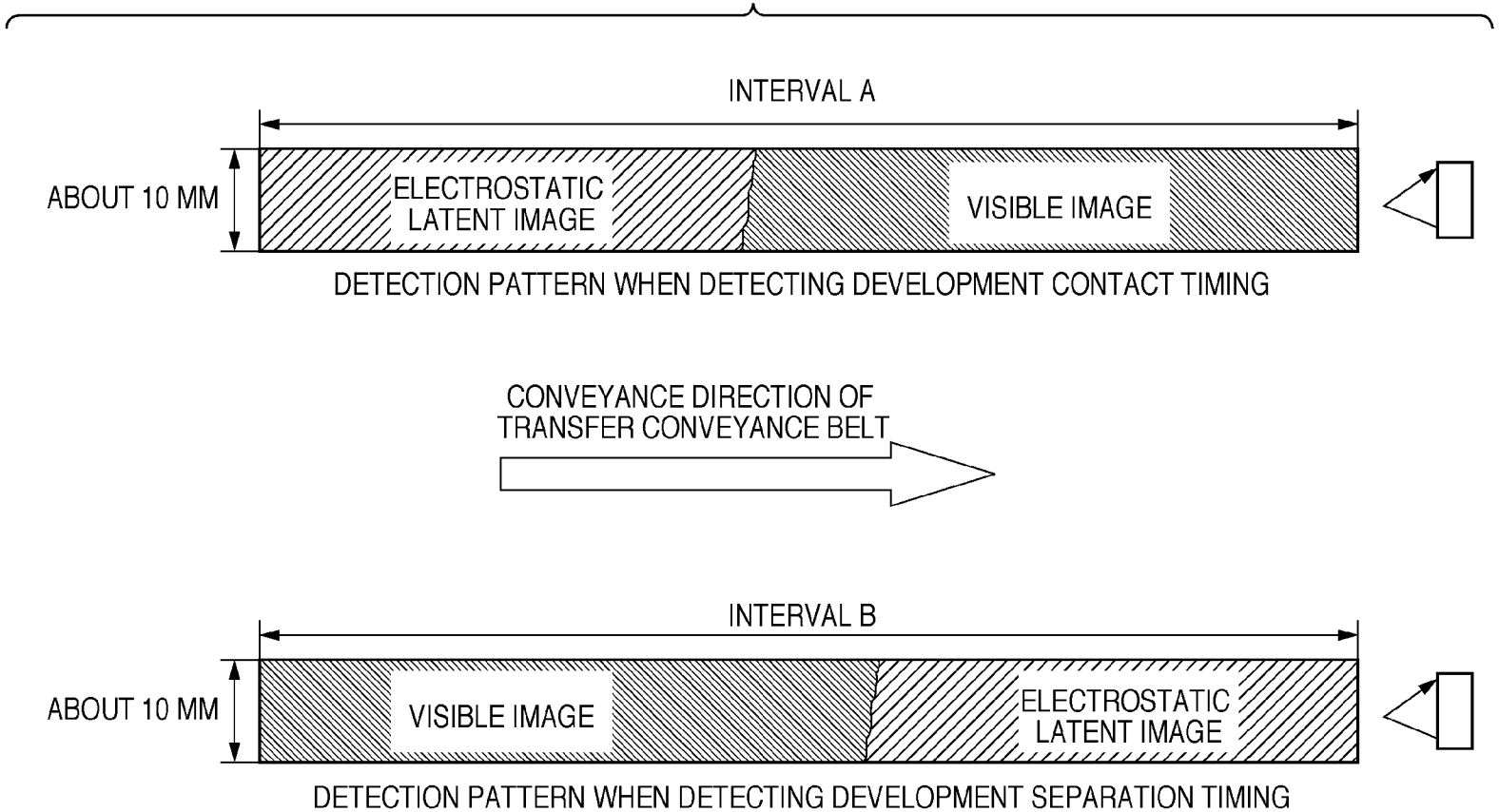
FIG. 11 shows example detection patterns for detecting timing of contact/separation of the photosensitive drum and the development roller in the first embodiment.

Development Contact Time and Development Separation Time Determination Processing Next is a detailed description of a method for detecting development contact and separation times according to the present embodiment, with reference to FIGS. 8, 9, 10, 11, and 12. FIG. 8 is a flowchart of a control program that detects development contact and separation times. The procedure in FIG. 8 is realized by, for example, the CPU 121 executing a program stored in the ROM 122. FIG. 9 shows an overview of, when detecting the development contact timing, states on the intermediate transfer belt 51, detection signals of the registration detection sensor 56, and main body sequence operation timing. FIG. 10 shows an overview of, when detecting the development separation timing, states of the detection pattern 81 on the intermediate transfer belt 51, detection signals of the registration detection sensor 56, and main body sequence operation timing. FIG. 11 shows an overview of the detection pattern 81 used to detect the development contact timing and separation timing.

In FIG. 8, first detection of whether or not a process cartridge has been exchanged is performed (S1), and when determined that a process cartridge has been exchanged, the stepper motor 91 is started (S2). At this time a timer is also started. The meaning of Step S1 is that processing is started from Step S2, triggered by exchange of a process cartridge. Next, formation of a predetermined detection pattern 81 is started (S3). That is, formation of a latent image of the detection pattern 81 is started. Note that the detection pattern 81 has a width in the main scanning direction that is at least detectable by the registration detection sensor 56.

Parallel with formation of the detection pattern 81, detection of the detection pattern 81, which has been made visible by the development roller 64 contacting against the photosensitive drum 61, is attempted by the registration detection sensor 56 (S4). Detection is "attempted" because the detection pattern 81 is not developed, and cannot be detected, until the development roller 64 contacts against the photosensitive drum 61. That is, part of the latent image of the detection pattern 81 is developed. If the detection pattern 81 is successfully detected, the timer started in Step S2 is immediately stopped. Then, once the stepper motor 91 has been rotated by the predetermined number of steps to the full-color contact state, the stepper motor 91 is stopped in that state (S5). Next, the development contact completion passed time As measured by the timer is stored in a memory or the like (S6). With the above processing, the leading edge of the detection pattern 81 is detected, the development contact completion passed time As is measured, and so the development contact time Xs can be obtained.

Next, from the full-color contact state, the stepper motor 91, which changes the position of the development roller 64, is started (S7), and parallel with this, formation of the latent image of the detection pattern 81 is started (S8). Note that the stepper motor 91 may also be continuously driven, and formation of the detection pattern 81 continued, from the prior step S3, and in that case S7 and S8 can be omitted. Parallel with this, detection of the trailing edge of the visible image of the detection pattern 81 by the registration detection sensor 56 is attempted (S9). The trailing edge of the detection pattern 81 indicates the position, in other words, the timing, at which development of the electrostatic latent image of the detection pattern 81 is no longer possible due to the development roller 64 separating from the photosensitive drum 61. Then, once the relationship of the photosensitive drum 61 and the development roller 64 has reached the standby state, the stepper motor 91 is stopped (S10). Based on the signal of the registration detection sensor 56 that performed the detection above, the development separation completion passed time (separation time) Cs from starting of the stepper motor 91 until the detection pattern 81 can no longer be detected is stored (S11). With the above processing, the trailing edge of the detection pattern is detected, the development separation completion passed time Cs is measured, and so the development separation time Ys can be obtained.

As described above, measurement of the contact time As and the separation time Cs is carried out in each station S (S12). When measurement is finished, based on the longest development contact time max (Xs) among all stations, the drive timing at which the stepper motor 91 is started from the standby state and the drive speed of the stepper motor 91 are adjusted. This adjustment is performed specifically by adjusting the drive speed of the stepper motor 91 such that the max (Xs) becomes the margin time shown in FIG. 24. However, because there is a range of speeds that can be adopted for the stepper motor 91, when it is necessary to deviate from that range and set a slower or faster speed, the drive start timing also is controlled to correspond to that speed (S13).

Specifically, where the margin time is Tm1, and the ordinary drive speed of the stepper motor 91 during contact is Vr1, a relationship Vr=(Vr1×Tm1)/max(Xs) may be adopted as a post-adjustment driving speed Vr. However, when the motor speed range is set to at least Vmn and not more than Vmx, if Vr<Vmn, the speed of the stepper motor 91 is set to a minimum speed of Vmn. In that case, the development roller contacts at a timing earlier by (Vmn×max(Xs)−Vr1×Tm1)/Vmn. This is not a problem for image forming and therefore may be allowed, but it is desirable that the start of driving of the stepper motor 91 is delayed by this amount of time. The reason for this is that such a scheme is suitable for the initial objective of preventing wearing out of the photosensitive drum 61.

Also, based on the shortest development separation time min (Ys) among all stations, the drive timing at which the stepper motor 91 is started from the full-color contact state and the drive speed of the stepper motor 91 are both adjusted (S13).

Specifically, the time needed from starting driving of the motor for separation until separation is complete is Tm2, and the ordinary drive speed of the stepper motor 91 during separation is Vr2. With the drive speed Vr after adjustment set to Vr2, the start timing is made earlier. The new start timing is adjusted such that the development roller 64 of the station that separates earliest (that is, with the shortest development separation time) separates at the timing that the image forming guarantee time ends. That is, the new start timing is adjusted such that the start timing of the stepper motor 91 is made earlier by a time obtained by subtracting from min(Ys) the time from starting driving of the stepper motor 91 in the full-color contact state until the timing that the color image forming guarantee time ends. Of course, the time that the development roller 64 and the photosensitive drum 61 are in contact is shorter as the motor drive speed increases, so Vr may also be set to Vmx. In that case, the start timing of the stepper motor 91 will be accelerated by a lesser amount, to the extent of that difference in speed.

Detection and Adjustment of Development Contact Time

Control to detect the development contact timing and measure the development contact time will be described in detail with reference to FIG. 9. In cam diagram 1204 in FIG. 9, the difference in detection times caused by the phase difference between the cams of each station is compensated. That is, in this diagram the phases of other stations are matched to the phase of the station 1 in the standby state. As shown in FIG. 9, a signal that starts driving of the stepper motor 91, which is the drive source of the contact/separation mechanism of the development roller 64, is output (t11). Afterward, in the period until contact completes (t14) (interval A) in the cam diagram, the electrostatic latent image of the detection pattern 81 is formed on the photosensitive drum 61. In FIG. 9, in the cam diagram, latent image formation is started at the timing of contact start (t12), but also may be started at timing t11. This detection pattern 81 is formed on the photosensitive drum 61 as an electrostatic latent image, but when the development roller 64 contacts against the photosensitive drum 61 (t131, t132, t133, and t134), the electrostatic latent image on the photosensitive drum 61 is made visible as a visible image. The detection pattern 81 made visible is detected with the registration detection sensor 56. The development contact time (As) from the start of stepper motor 91 driving until the detection pattern 81 is detected by the registration detection sensor 56 is measured for the process cartridge of each station, and the respective development contact times As are fed back to the image forming control unit 12. The start timing of the stepper motor 91 is determined according to the longest time among the respective development contact times. In FIG. 9, the development contact time A4 of the station 4 is longest. Consequently, using station 4 as a reference, the speed and if necessary the start timing of the stepper motor 91 is adjusted so as to shift the timing t134 when the development roller 64 contacts in the station 4 to the image forming guarantee time start timing t14. That is, the cam diagram 1204 is shifted to the dotted line 1204'. Therefore, in the cam diagram, because development contact is completed at the timing t16, the stepper motor 91 stops at the subsequent timing t17. Since the number of driving steps determines the timing of stoppage, the stoppage timing changes according to speed adjustment, but there is no particular change in control.

Detection and Adjustment of Development Separation Time

Control to detect the development separation timing will be described in detail with reference to FIG. 10. Detection of the development separation timing is performed immediately after the development contact time is measured, so the state in which the development roller 64 has contacted against the photosensitive drum 61 (the full-color state) is the state when started. In cam diagram 1304 in FIG. 10 as well, the difference in detection times caused by the phase difference between the cams of each station is compensated. When a signal that starts driving of the stepper motor 91 is output (t21), in the period from the start of separation of the development roller 64 (t22) until separation completes (t24) (interval B) in the cam diagram, the detection pattern 81 is formed as an electrostatic latent image on the photosensitive drum 61. The detection pattern 81 is made visible as a visible image (a toner-developed image), but when the development roller 64 separates from the photosensitive drum 61 the detection pattern 81 becomes an electrostatic latent image, and can no longer be detected by the registration detection sensor 56. Consequently, the development contact time (Cs) from the start of driving of the stepper motor 91, which is the drive source, until the registration detection sensor 56 can no longer detect the detection pattern 81 is measured for the process cartridge of each station. Then, both or either one of the start timing and the drive speed of the stepper motor 91 is adjusted in coordination with the station having the longest measured time. In the example in FIG. 10, the detection timing of the trailing edge of the detection pattern 81 is, in order from the station 1, timings t221, t222, t223, and t23. The detection pattern 81 of the station 4 is shown by way of example. Using the shortest development separation time C4 as a reference, the drive start timing of the stepper motor 91 is advanced by time P3 such that the timing t221 moves to the timing t22. However, in the example in FIG. 10 the drive speed of the stepper motor 91 also is increased.

Next is a detailed description of the detection pattern 81 used when measuring the development contact time and the development separation time, with reference to FIG. 11. As shown in FIG. 11, it is sufficient that the width of the detection pattern 81 is in a range detectable by the registration detection sensor 56 (about 10 mm), and the length of the detection pattern 81 includes the range of interval A on the development contact side, and includes the range of interval B on the development separation side. Also, the detection pattern 81 is preferably a solid image in the forming range of the detection pattern 81 such that the development contact timing and the separation timing can be precisely detected.

Figure 12:
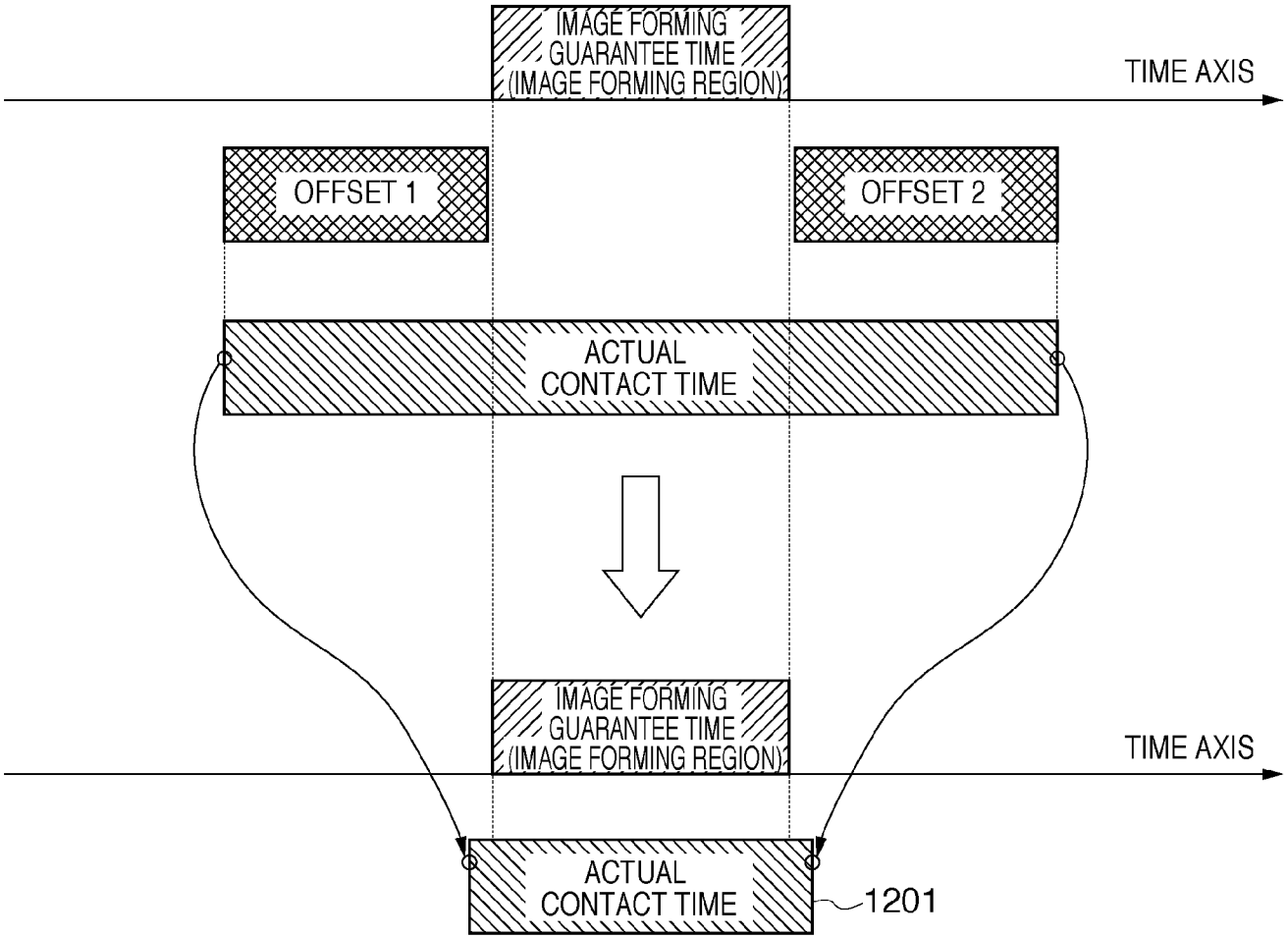
FIG. 12 shows an example of a time when the photosensitive drum and the development roller are contacted in the first embodiment.

As described above, in the combination of the main body and the process cartridge that is actually used, it is possible to measure the development contact time and the development separation time. Therefore, when an image signal has been sent out to the main body, by starting the stepper motor 91 at a timing based on the measured development contact time and development separation time, it is possible to perform control at an optimal timing for an image guarantee region (FIG. 12). In the example in FIG. 12, an optimal variation in the timing absorbed by the margin before and after the image forming guarantee time is adopted, and so the time during which the development roller 64 is actually contacted against the photosensitive drum 61 can be brought near the image forming guarantee time.

As described above, in the combination of the main body and the process cartridge that is actually used, development contact and separation are performed, and the leading edge and trailing edge of the detection pattern 81 transferred to the intermediate transfer belt 51 are detected with the registration detection sensor 56. Thus, the development contact timing and the development separation timing in each image forming station can be adaptively controlled for each image forming apparatus.

Thus, the margin before and after the image forming guarantee period, which was a problem in the conventional technology, can be shortened, and so shortening of the process cartridge life due to unnecessary contact of the development roller 64 and the photosensitive drum 61 can be prevented.

Second Embodiment

In the first embodiment, detection patterns 81 of each color are respectively formed on the intermediate transfer belt 51 and detected, and by performing this for each color, a development contact time and a development separation time are measured for each color. Thus, the drive timing and the drive speed of the stepper motor 91 are adjusted. That is, formation and detection of a detection pattern 81 is repeated four times. In the present embodiment, an example is disclosed in which by forming detection patterns 81 of each color on the intermediate transfer belt 51, and detecting them in windows of each color, the time needed to adjust the drive timing and the drive speed of the stepper motor 91 is shortened. The configuration of the image forming apparatus according to the present embodiment is the same as in the first embodiment, but differs in the procedure for forming and detecting the detection patterns 81 of each color. Accordingly, below mainly those differences will be described.

Figure 13:
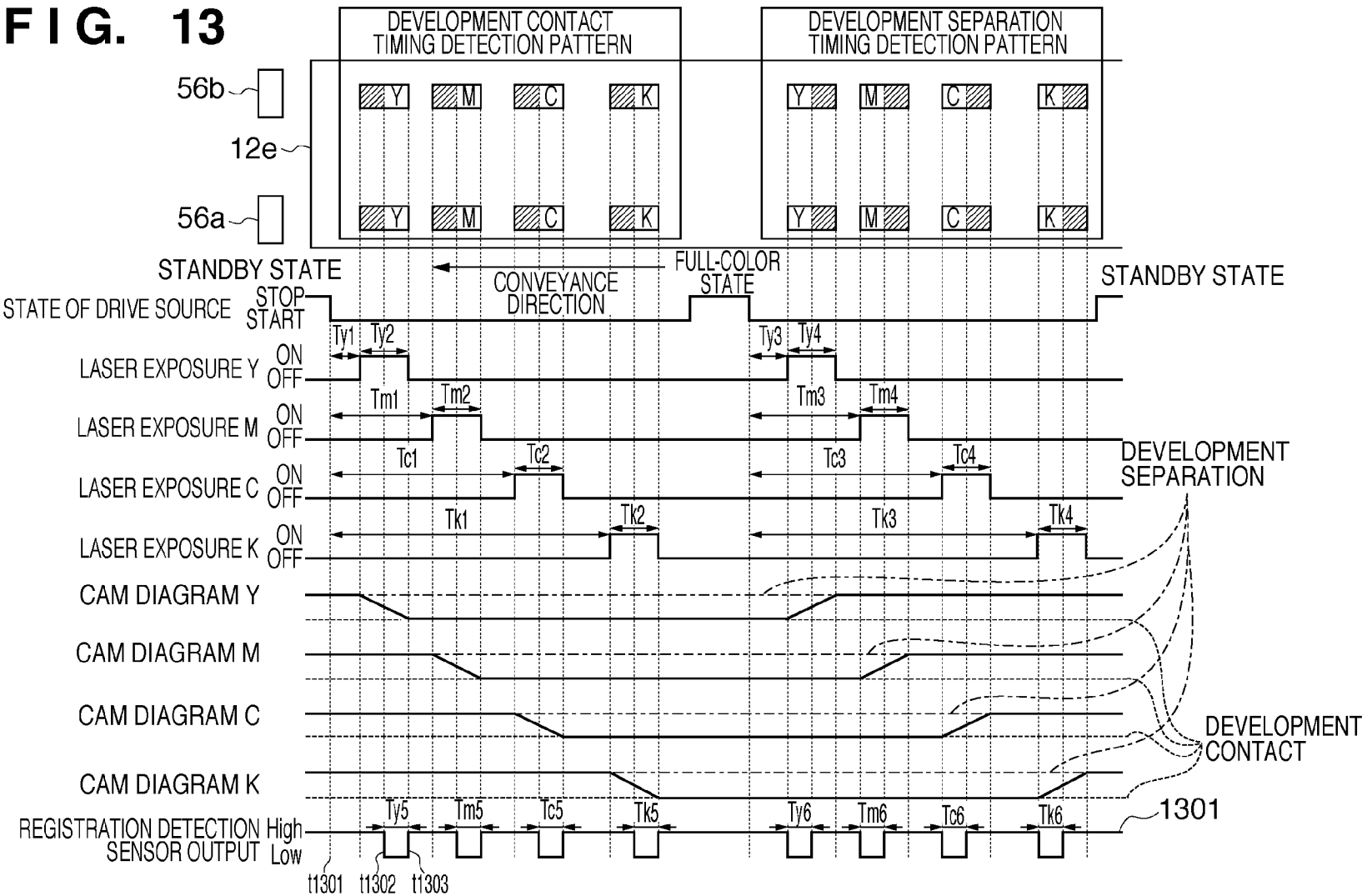
FIG. 13 is a diagram of timing of detecting contact/separation of a photosensitive drum and a development roller in a second embodiment.

Method for Detecting and Adjusting Development Contact Timing and Separation Timing The method for detecting and adjusting the development contact timing and separation timing in the present embodiment will be described with reference to FIG. 13. FIG. 13 shows detection patterns 81 for detecting contact or separation timing, laser emitting timings when forming the detection patterns 81, separation cam states, and output waveforms of image detection sensors. In FIG. 13, the timings in cam diagrams and so forth are shown without compensation of the phase difference between cams of the respective stations.

When control of detection of the development contact timing and the separation timing is started, the stepper motor 91, which is the drive source of the mechanism for separation from the standby state, is started, and the state changes from development separation to the contact state. The stepper motor 91 stops in the full-color contact state. In coordination with the timing of starting of the stepper motor 91, the lasers of each image forming station are turned on after passage of respective periods Ty1, Tm1, Tc1, and Tk1, and the photosensitive drum 61 is scanned with a laser beam according to the shape of the detection pattern 81. The shape of the detection pattern 81, particularly the length in the sub-scanning direction, is the same for each color. This length corresponds to the shape of the latent image, not the visible image developed with toner. The periods Ty2, Tm2, Tc2, and Tk2 during which the lasers of each image forming station are scanning the photosensitive drum 61 are indefinite periods of the change from the separation state to the contact state, and are predetermined according to the cam diagrams.

Next, from the full-color contact state, the stepper motor 91 starts and in each station the development roller 64 sequentially separates, thus changing to the standby state. In coordination with the timing of starting of the stepper motor 91, the lasers of each image forming station are irradiated onto the photosensitive drum 61 at timings Ty3, Tm3, Tc3, and Tk3. Likewise for periods Ty4, Tm4, Tc4, and Tk4 during which the lasers of each image forming station are on, these are periods in which the separation cam state is in an indefinite region, and are predetermined according to the cam diagrams.

As shown in FIG. 13, the detection patterns 81 are configured with vertical strip-like patterns disposed in the order Y (yellow), M (magenta), C (cyan), K (black) so as to pass directly below the registration detection sensors 56*a* and 56*b*. The diagonal line portions in FIG. 13 indicate regions where only an electrostatic latent image is formed on the photosensitive drum 61, and the image is not developed because the development roller 64 has been separated. The detection pattern 81 is formed at a darkness of 100% for each color.

In the present embodiment, in order to shorten the time needed for detection of the development contact timing and the separation timing, the development contact and separation timing of each color is detected in one development contact and separation operation. When performing ordinary printing, when development contact is started, the development rollers 64 contact in the order that the stations are disposed, beginning from the upstream side of the intermediate transfer belt 51. The development rollers 64 contact against the photosensitive drums 61 in the order yellow (Y) image forming station (1st)→magenta (M) image forming station (2nd)→cyan (C) image forming station (3rd)→black (K) image forming station (4th). The timing at which the development roller 64 of each image forming station contacts is controlled such that the leading edges of the image forming regions formed in the image forming units of each color are aligned. That is, the images formed immediately after sequential development contact in each image station are transferred at approximately the same position on the intermediate transfer belt 51. Consequently, in order to detect the development contact and separation timing of each color in one development contact and separation operation, the rotational speed of the stepper motor 91 is changed. Thus, the ratio of the conveyance speed of the intermediate transfer belt 51 and the drive speed of the stepper motor 91 at which development contact and development separation are performed is changed to a different ratio than when performing ordinary printing. Thus, the position of the detection pattern 81 of each color is offset on the intermediate transfer belt 51. For example, where only the speed of the stepper motor 91 is set to half to the ordinary speed, twice as much time as in the ordinary case is taken from when development contact occurs in a particular station to when development contact occurs in the next station. During that time, the intermediate transfer belt 51, which is being conveyed at the ordinary speed, is conveyed past the ordinary transfer position. Therefore, the position of the detection pattern 81 of each color is offset. This position offset occurs even when only increasing the speed of the stepper motor 91.

Note that in the control of detection of the development contact timing and separation timing, the rotational speed of the stepper motor 91 is controlled to be slower than when a printing operation is performed, and in the present embodiment the stepper motor 91 rotates at ½ the rotational speed during a printing operation. Accordingly, it takes twice as much time as in an ordinary case for each development contact completion passed time and separation completion passed time, and this is indicated by the equation stepper motor 91 rotational speed relative value Rv=2.

In FIG. 13, registration detection sensor output 1301 is the output waveform when the registration detection sensor 56 has detected the detection pattern 81. The registration detection sensor 56, by detecting the detection pattern 81, is able to detect times Ty5*, Tm5*, Tc5*, and Tk5* when development contact occurs prior to the contact timing on the cam diagrams. The contact timing on the cam diagrams corresponds to the image forming guarantee time start timing after the margin shown in FIG. 24. Also, the registration detection sensor 56 is able to detect times Ty6*, Tm6*, Tc6*, and Tk6* (*=a, b) when development separation occurs subsequent to the separation timing on the cam diagrams. The separation timing on the cam diagrams corresponds to the image forming guarantee time end timing shown in FIG. 24. Here, * corresponds to detection results by the registration detection sensor 56*a* or 56*b*, and in FIG. 13 indicates detection results common to both registration detection sensors.

In the control of detection of the development contact timing and the separation timing, the rotational speed of the stepper motor 91 is changed. Therefore, it is necessary to determine the development contact timing and the separation timing after correcting the detected times Ty5*, Tm5*, Tc5*, and Tk5*, and Ty6*, Tm6*, Tc6*, and Tk6* (*=a, b). A development contact timing correction amount Tt and a development separation timing correction amount Tr can be calculated from the below formulas.

$$Tt=\mathrm{MIN}(Ty5^*,Tm5^*,Tc5^*,Tk5^*)/Rv \quad (2\text{-}1)$$

$$Tr=\mathrm{MIN}(Ty6^*,Tm6^*,Tc6^*,Tk6^*)/Rv \quad (2\text{-}2)$$

Rv: stepper motor 91 rotational speed relative value *=a, b

As indicated by the above formulas, for the development contact timing, the development contact timing correction amount Tt is calculated from the detected times Ty5*, Tm5*, Tc5*, and Tk5* (*=a, b), using the image forming station having the shortest development contact time as a reference. When performing printing, the start timing of the contact/separation mechanism when changing from the standby state to the full-color contact state is delayed by the calculated development contact timing correction amount Tt.

For the development separation timing, the development separation timing correction amount Tr is calculated from the detected times Ty6*, Tm6*, Tc6*, and Tk6* (*=a, b), using the image forming station having the shortest development contact time as a reference. When performing printing, the start timing of the contact/separation mechanism when changing from the full-color contact state to the standby state is accelerated by the calculated development separation timing correction amount Tr. By starting the contact/separation mechanism at an optimal development contact timing and separation timing, the development contact time can be adjusted to be as short as possible.

Note that in the first embodiment, in FIG. 13, the timer is started from a timing t1301, and for example with respect to the station Y, the time until a timing t1302 is measured. Here, the time t1301 to t1303 is determined by the mechanism or motor drive speed. Accordingly, the same value is obtained by measuring the time t1301 to t1302 and by measuring the time t1302 to t1303, as in the present embodiment. Therefore, in the present embodiment, the time t1301 to t1302 may be measured as in the first embodiment, or conversely, in the first embodiment the time t1302 to t1303 may be measured. Of course, this is also true with respect to a station of a color component other than Y.

Figure 14:
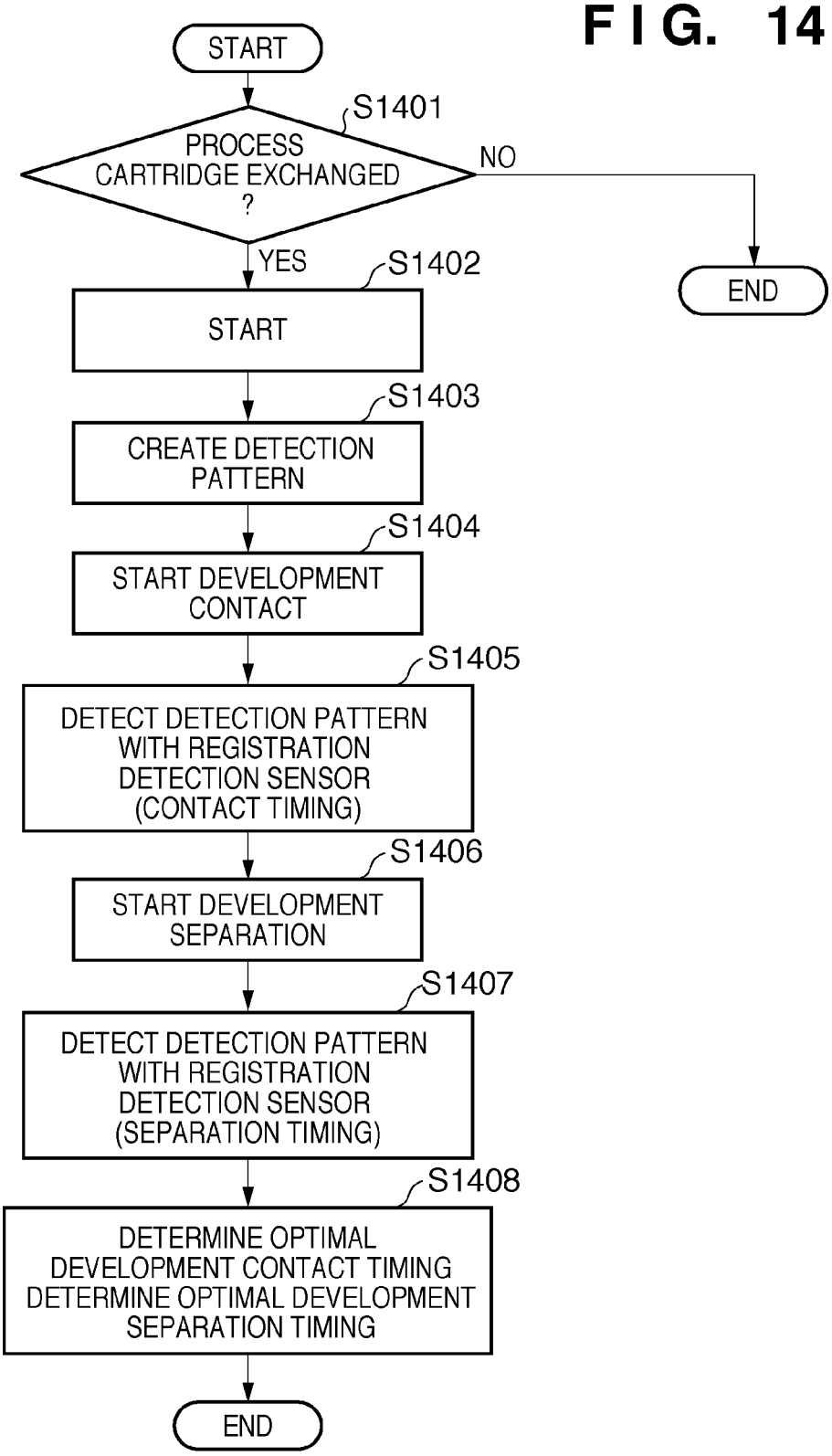
FIG. 14 is a flow diagram of a control program that detects timing of contact/separation of a photosensitive drum and a development roller in the second embodiment.

Next, FIG. 14 shows a flowchart of the control to detect the development contact timing and the separation timing according to the present embodiment. For example, the CPU 121 of the image forming control unit 12 executing a program stored in the ROM 122 realizes the procedure in FIG. 14. As shown in FIG. 14, first detection of whether or not a process cartridge has been exchanged is performed (S1401), and when determined that a process cartridge has been exchanged, the processing proceeds to S1402. Processing may also be started from S1402, triggered by exchange of a process cartridge. In S1402, in order to detect the development contact timing and the separation timing, the registration detection sensor 56 or the like is started, and a drive source (excluding the stepper motor 91) of the photosensitive drum 61 and the intermediate transfer belt 51 and the like is started (S1402). Then, the detection pattern 81 is formed (S1403), and the stepper motor 91 is driven to start the contact operation of the development roller 64 and the photosensitive drum 61 (S1404). During this step as well, the registration detection sensor 56 attempts to detect the detection pattern 81. The detection pattern 81 has a width in the sub-scanning direction such that laser scanning ends at the timing (for example, t1303) that the development roller 64 contacts against the photosensitive drum 61 in the cam diagram in FIG. 13. When the development roller 64 contacts against the photosensitive drum 61 and the registration detection sensor 56 detects an edge portion, for example the leading edge and the trailing edge, of the detection pattern 81 that has been made visible, the development contact timing correction amount Tt is calculated from a detection result Tx5 (where x represents Y, M, C, or K), and stored (S1405). Here, as shown in FIG. 13, the detection patterns 81 of each color are each isolated patterns, so the respective patterns can be independently measured.

Next, the development separation operation is started (S1406), the detection pattern 81, which has become an electrostatic latent image due to separation of the development roller 64, is detected by the registration detection sensor 56, and the development separation timing correction amount Tr is calculated from the detection results, and stored (S1407). An optimal contact timing and separation timing are determined from the detected development contact timing correction amount and development separation timing correction amount (S1408). Here, as shown in FIG. 13, the detection patterns 81 of each color are each isolated patterns, so the respective patterns can be independently measured.

That is, Tt=MIN(Ty5*,Tm5*,Tc5*,Tk5*)/Rv is calculated. The stepper motor 91 is controlled such that the start timing of the contact/separation mechanism when changing from the standby state to the full-color contact state when printing is delayed from the presently set value by the correction value Tt. Also, Tr=MIN(Ty6*,Tm6*,Tc6*,Tk6*)/Rv is calculated. The stepper motor 91 is controlled such that the start timing of the contact/separation mechanism when changing from the full-color contact state to the standby state when printing is accelerated from the presently set value by the correction value Tr.

Note that in the present embodiment, when performing ordinary printing, only the start timing is changed and not the speed of the stepper motor 91, but of course the speed may be changed as in the first embodiment.

As described above, in the actually used combination of the main body and a process cartridge, development contact and separation are performed, and the leading edge and trailing edge of the detection pattern 81 transferred to the intermediate transfer belt 51 is detected with the registration detection sensor 56. By doing so, it is possible to accurately know the development contact timing and the development separation timing in each combination. Also, it is possible to detect the contact timing and the separation timing in one development and separation operation, and thus possible to shorten the detection time. Thus, it is possible to optimally correct the development contact timing and the development separation timing in each detected process cartridge. As a result, it is possible to set the time that the development roller 64 is contacted against the photosensitive drum 61 to as short a time as possible, and therefore planing of the photosensitive drum 61 by the development roller 64 can be reduced, and so an image forming apparatus can be provided that is advantageous with respect to process cartridge life.

Furthermore, measurement of the stations of each color of a full-color image forming apparatus can be accomplished in a single image forming operation, so it is possible to shorten the adjustment time of development contact and development separation.

Modified Example of Second Embodiment

Following is a description of a variation of the second embodiment of the image forming apparatus according to the present invention. In the present embodiment, a description is given of a configuration of an image forming apparatus in which the timing of contact or separation of the development roller 64 and the photosensitive drum 61 at a position determined in the main scanning direction is delayed, and development contact timing and separation timing are detected using a detection pattern 81 in which the amount of toner consumption is small. Descriptions given in the first and second embodiments are not repeated here.

Figure 15:
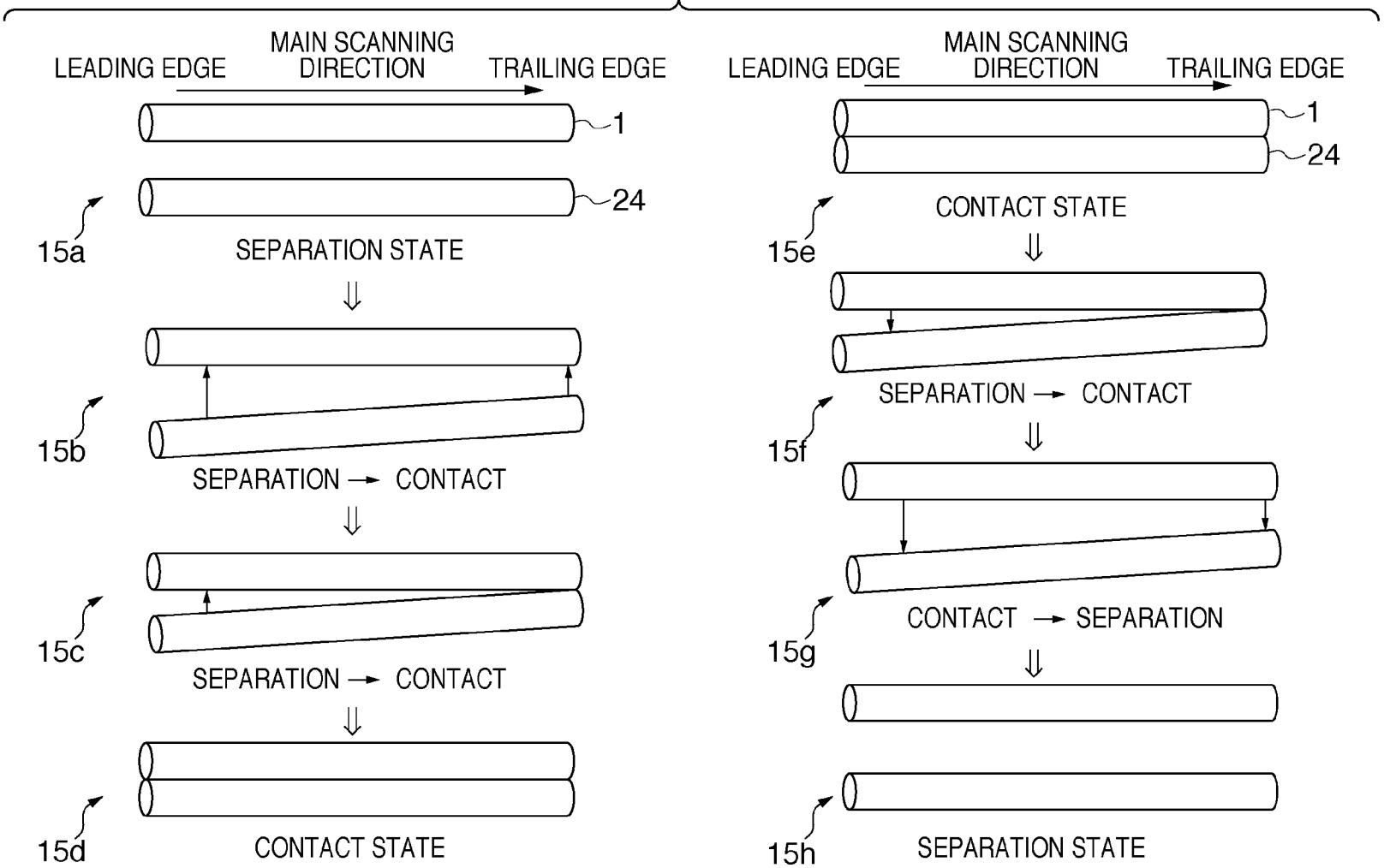
FIG. 15 shows example contact/separation states of the photosensitive drum and the development roller in the second embodiment.

15*a* to 15*h* in FIG. 15 show contact and separation states of the photosensitive drum 61 and the development roller 64 in the present example. 15*a* to 15*d* in FIG. 15 show states of switching from separation to contact. 15*e* to 15*h* in FIG. 15 show states of switching from contact to separation. As shown in 15*a* to 15*d* in FIG. 15, during switching from separation to contact, the photosensitive drum 61 and the development roller 64 abut later at the leading edge side than the trailing edge side in the main scanning direction. The trailing edge side is the side pressed against by the cam 95, and is the side where the registration detection sensor 56*b* is disposed. Also, as shown 15*e* to 15*h* in FIG. 15, during switching from contact to separation, the photosensitive drum 61 and the development roller 64 contact later at the trailing edge side than the leading edge side in the main scanning direction. These slight delays in the development contact and separation timing are determined by the mechanical configuration of the process cartridges and the printer main body. In the present embodiment, the position where the development contact timing is delayed is the leading edge side in the main scanning direction, and the position where the development separation timing is delayed is the trailing edge side in the main scanning direction.

Figure 16:
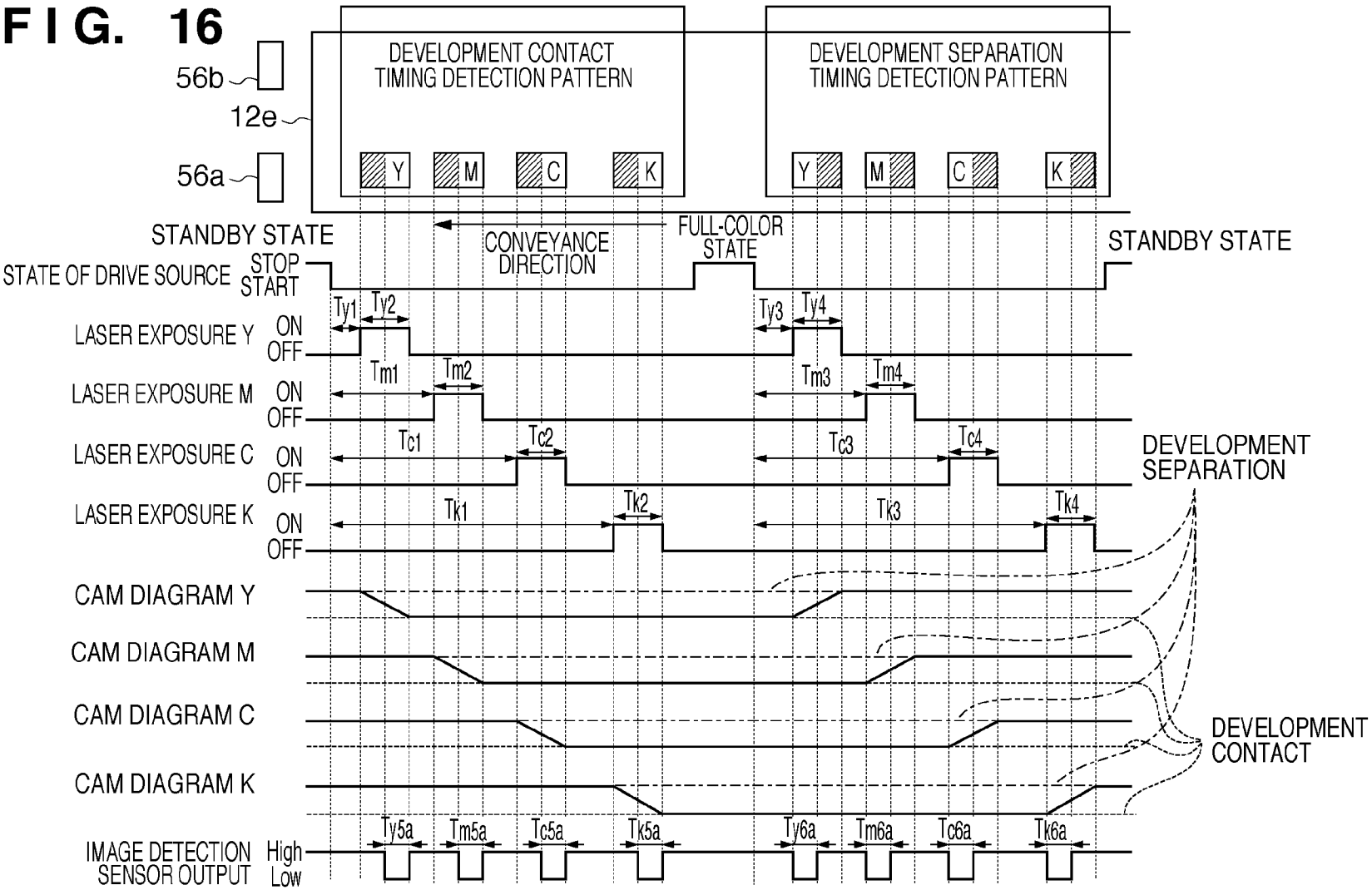
FIG. 16 is a diagram of the timing of detecting contact/separation of the photosensitive drum and the development roller in the second embodiment.

Method for Detecting and Optimizing Development Contact Timing and Separation Timing A method for detecting and optimizing the development contact timing and the separation timing in this modified example of the present embodiment will be described with reference to FIG. 16. FIG. 16 shows detection patterns 81 for detecting contact or separation timing, laser emitting timings when forming the detection patterns 81, cam diagrams, and output waveforms of the registration detection sensors 56. Compared to the detection patterns 81 in FIG. 13, a pattern that passes directly under the registration detection sensor 56*b* is deleted; there is only a pattern that passes directly under the registration detection sensor 56*a* disposed on the leading edge side.

Operation itself is substantially the same as in the second embodiment. However, because a detection pattern 81 can only be detected with the registration detection sensor 56*a*, only detection results from the registration detection sensor 56*a* are used for determining a correction amount. Accordingly, the correction amounts Tt and Tr are given by the below formulas.

$$Tt=\mathrm{MIN}(Ty5a, Tm5a, Tc5a, Tk5a)/Rv \quad (2\text{-}1')$$

$$Tr=\mathrm{MIN}(Ty6a, Tm6a, Tc6a, Tk6a)/Rv \quad (2\text{-}2')$$

Rv: stepper motor 91 rotational speed relative value

The stepper motor 91 is controlled such that when performing printing, the start timing of the contact/separation mechanism when changing from the standby state to the full-color contact state is delayed from the presently set value by the correction amount Tt. Also, the stepper motor 91 is controlled such that when performing printing, the start timing of the contact/separation mechanism when changing from the full-color contact state to the standby state is accelerated from the presently set value by the correction amount Tr. Otherwise, this modified example is the same as the second embodiment.

The reason for adopting such a configuration is that it is sufficient to only detect the development contact timing and the separation timing at the main scanning position, where the margin time is short for image omission. A short margin time for image omission means that there is a greater delay of contact for the development contact time, and a greater acceleration of separation for the development separation time. Accordingly, among the detection patterns 81 in the second embodiment, the pattern on the side where the margin time is long relative to image omission, that is, the pattern on the side of the sensor 56*b*, can be omitted.

Thus, in an image forming apparatus in which the position where the development contact or separation timing is delayed is determined in the main scanning direction, the detection pattern 81 used to detect the development contact timing, in the region detectable by the registration detection sensor 56, is formed only at the main scanning position where development contact is most delayed. Also, the detection pattern 81 used to detect the development separation timing, in the region detectable by the registration detection sensor 56, is formed only at the main scanning position where development separation is most accelerated. By adopting such a configuration, it is possible to reduce the amount of toner consumed, and while losing as little precision as possible, the time that the development roller 64 is contacted against the photosensitive drum 61 can be made as short as possible.

Second Modified Example of Second Embodiment

Here, a modified example will be disclosed in which only the correction method is changed from the above modified example of the second embodiment. In control of detection of the development contact timing and separation timing, the rotational speed of the stepper motor 91 is changed. Therefore, it is necessary to determine the development contact timing and the separation timing after optimizing the detected times Ty5*a*, Tm5*a*, Tc5*a*, and Tk5*a*, and Ty6*a*, Tm6*a*, Tc6*a*, and Tk6*a*. The development contact timing correction amount Tt and the development separation timing correction amount Tr can be calculated from the below formulas.

$$Tt=\mathrm{MIN}(Ty5a, Tm5a, Tc5a, Tk5a)/Rv-\alpha \quad (2\text{-}1'')$$

$$Tr=\mathrm{MIN}(Ty6a, Tm6a, Tc6a, Tk6a)/Rv+\beta \quad (2\text{-}2'')$$

Rv: stepper motor 91 rotational speed relative value

Here, α and β in the formulas represent margin times in consideration of effects of sensor output response and variation in control, variation in development contact and separation delay times, and the like. As in this modified example, some additional time may be considered as a margin for omission of the leading edge and trailing edge of an image. Also, addition and subtraction of this margin time may be likewise applied to other embodiments.

Thus, in an image forming apparatus in which the position where the development contact or separation timing is delayed is determined in the main scanning direction, the detection pattern 81 used to detect the development contact timing, in the region detectable by the registration detection sensor 56, is formed only at the main scanning position where development contact is most delayed. Also, the detection pattern 81 used to detect the development separation timing, in the region detectable by the registration detection sensor 56, is formed only at the main scanning position where development separation is most accelerated. By adopting such a configuration, it is possible to reduce the amount of toner consumed, and while losing as little precision as possible, the time that the development roller 64 is contacted against the photosensitive drum 61 can be made as short as possible.

Third Embodiment

Next is a description of an image forming apparatus in which development contact timing and separation timing are detected in a short required time, the time that the development roller 64 is contacted against the photosensitive drum 61 during an image forming operation is kept as short as possible, and thus shortening of the life of a process cartridge is prevented. The configuration of the present embodiment and the principles of control of the start timing and speed of the stepper motor 91 are the same as in the first embodiment and the second embodiment. However, in the present embodiment, the detection pattern 81 is different, and the method for detecting this detection pattern 81 also differs from the other embodiments. Mainly those differences will be described below.

Principles of Detecting Development Contact Timing and Development Separation Timing in Present Embodiment Following is a description of a method for detecting the development contact timing and the development separation timing of the development rollers 64 (64Y, 64M, 64C, and 64K) to the photosensitive drums 61 (61Y, 61M, 61C, and 61K) for each image forming station by one development contact and separation operation.

Figure 17:
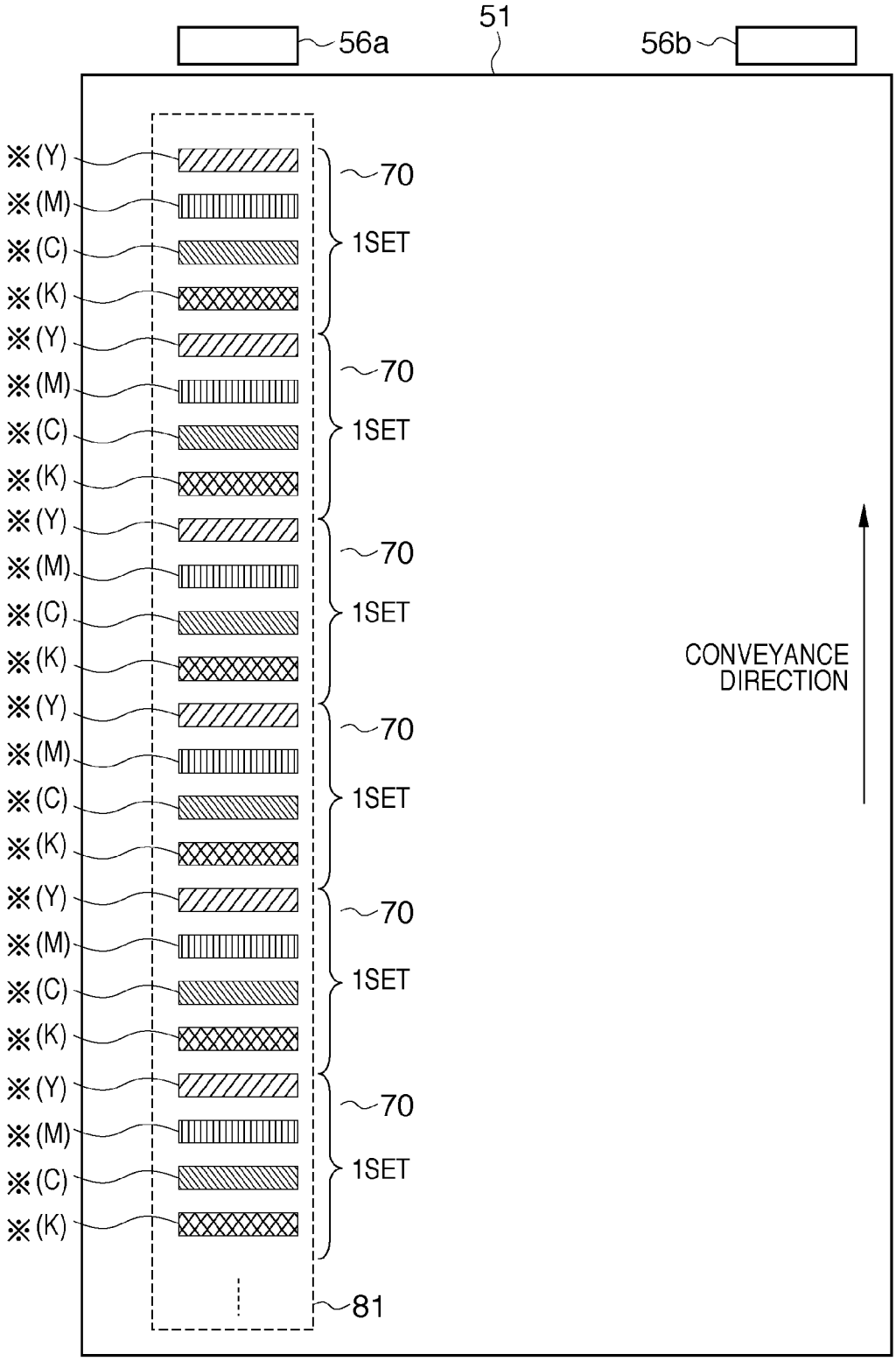
FIG. 17 shows example detection patterns for detecting timing of contact/separation of a photosensitive drum and a development roller in a third embodiment.

First, the detection patterns 81 for detecting the development contact timing and the development separation timing for each image forming station by one development contact operation and separation operation will be described with reference to FIG. 17. In order to detect the development contact timing and the development separation timing for each image forming station by one development contact operation and separation operation, it is necessary to start latent image formation of the detection patterns 81 as shown in FIG. 17 while the development separation state is indefinite, that is, while contact or separation is not yet completed. FIG. 17 shows the detection patterns 81 formed on the intermediate transfer belt 51. In the development contact/separation mechanism in the present embodiment, when performing the contact and separation operations of the development roller 64 to the photosensitive drum 61, contact does not occur throughout the width of the photosensitive drum 61 at the same time, rather, first the trailing edge side of the photosensitive drum 61 contacts, and lastly the leading edge side contacts. That is, when an electrostatic latent image is formed on the photosensitive drum 61 during the indefinite state of the development separation state prior to contact completion, in the detection patterns 81 on the intermediate transfer belt 51 formed due to completion of contact of the development roller 64, the leading edge side is formed later than the trailing edge side. Since a reliable contact completion timing can be detected by detecting the leading edge side pattern, the detection patterns 81 are formed only on the leading edge side. Accordingly, also with respect to the registration detection sensor 56, it is sufficient to use only the sensor 56*a*. The detection patterns 81 are formed at a position so as to pass directly below the registration detection sensor 56*a* on the leading edge side. One set of detection patterns is configured in the order first image forming station (yellow), second image forming station (magenta), third image forming station (cyan), fourth image forming station (black). This one set of the detection patterns 81 are repeatedly and periodically formed. Note that in the present embodiment, an example is disclosed in which the detection patterns 81 for detecting the timing at which the contact operation and the separation operation complete are formed at a position as described above, but this is only an example, and it is desirable to change this formation according to the configuration of the registration detection sensor 56 or the configuration of the image forming apparatus.

Figure 18:
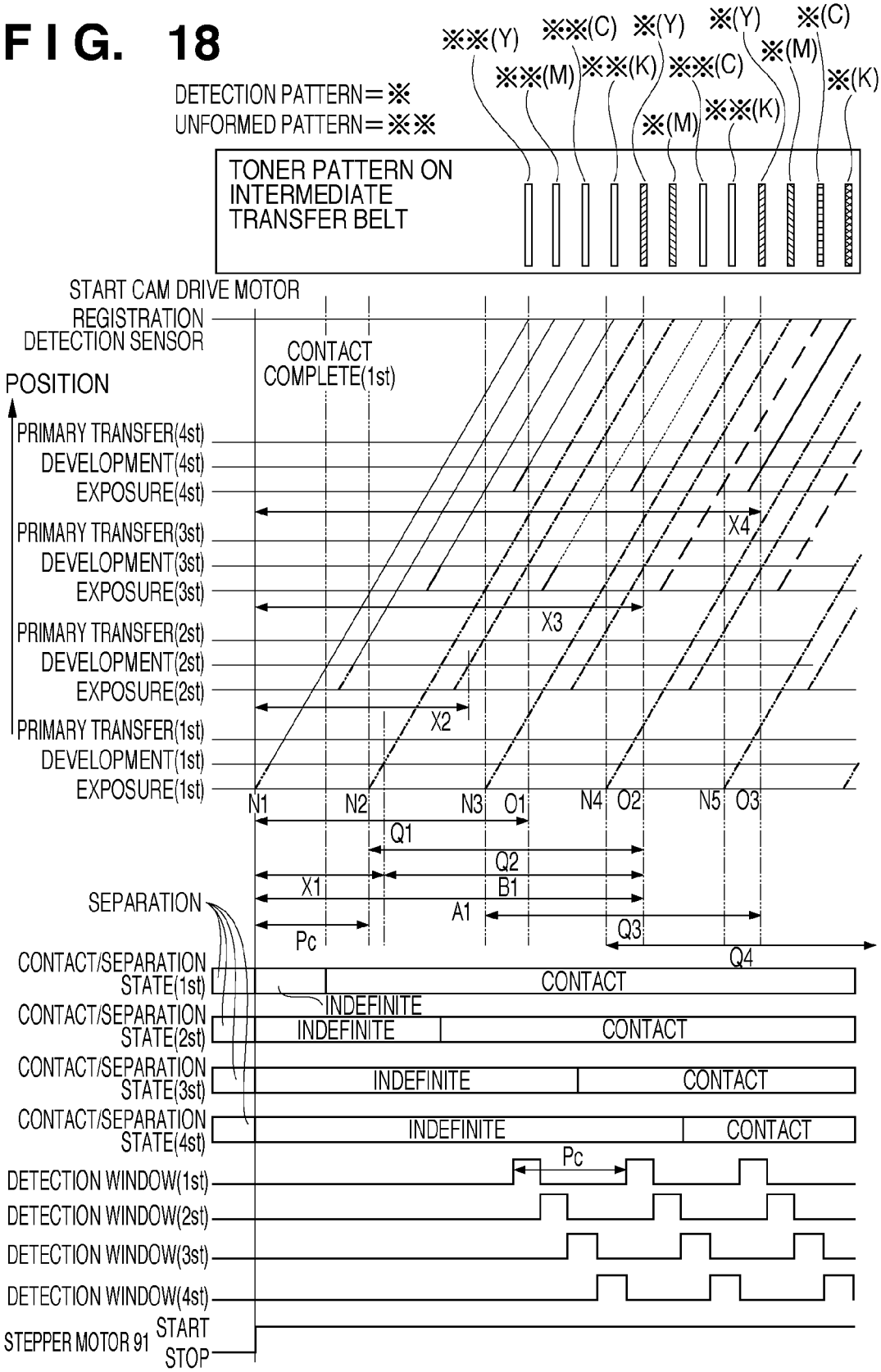
FIG. 18 is a diagram that shows detection states when detecting timing of separation of the photosensitive drum and the development roller in the third embodiment.

Next is a description of principles whereby it is possible to detect the development contact timing and the development separation timing of the development rollers 64 (64Y, 64M, 64C, and 64K) to the photosensitive drums 61 (61Y, 61M, 61C, and 61K) for each image forming station by one development contact and separation operation, with reference to the diagram shown in FIG. 18. The diagram in FIG. 18 shows the process from formation of an electrostatic latent image on the photosensitive drum 61 corresponding to the detection patterns 81 shown in FIG. 17 on the intermediate transfer belt 51, to detection with the registration detection sensor 56 of the detection patterns 81 on the intermediate transfer belt 51 formed due to contact. Time is shown on the horizontal axis, and the distance along a path from formation of an electrostatic latent image until a toner image arrives at the position of the registration detection sensor 56 is shown on the vertical axis. Here, taking as an example a method for detecting the development contact timing of the image forming station 1, is a description of principles for detecting the development contact timing of each image forming station with one development contact operation.

When switching the contact/separation state from the separation state (standby state) to the contact state, the stepper motor 91 is started. While the development contact/separation state is indefinite after starting the stepper motor 91, the electrostatic latent image of the detection patterns 81 shown in FIG. 17 is repeatedly formed on the photosensitive drum 61. Where the first exposure start timing of the detection pattern 81 of the image forming station 1 is N1, when an electrostatic latent image whose formation was started at timing N1 has been developed, the toner image thereof passes directly under the registration detection sensor 56 at a timing O1, where a time Q1 has passed since Q1. Consequently, a detection window of the image forming station 1 is set before the timing O1, for determining that the detection patterns 81 of the image forming station 1 have passed directly under the registration detection sensor 56. However, the electrostatic latent image that has been exposed on the photosensitive drum 61 at the timing N1 is not developed, because contact has not been completed at the development timing. Therefore, the detection patterns 81 are not formed on the intermediate transfer belt 51, and thus cannot be detected by the registration detection sensor 56. Where the exposure start timing of the detection patterns 81 of the image forming station 1 formed second is N2, when the electrostatic latent image formed at timing N2 has been developed, the toner image thereof passes directly under the registration detection sensor 56 at a timing O2, where a time Q2 has passed since N2. Consequently, a detection window of the image forming station 1 is set before the timing O2, for determining that the detection patterns 81 of the image forming station 1 have passed directly under the registration detection sensor 56. The electrostatic latent image exposed on the photosensitive drum 61 at the timing N2, because contact is completed at the development timing, is supplied with toner from the development roller 64 and becomes a toner image. The toner image formed on the photosensitive drum 61 is transferred onto the intermediate transfer belt 51, and detected by the registration detection sensor 56 at timing O2. Thus, the development contact timing X1 of the image forming station 1 is the difference between a passed time A1 from starting of the stepper motor 91 until the timing O2 where a detection pattern 81 is detected by the registration detection sensor 56, and a time B1. The time B1 is the time until the toner image developed in the first station reaches the registration detection sensor 56, and is given as a fixed value based on the distance and conveyance speed during that period. The time X1 can be calculated from formula (1) in the first embodiment, in other words:

$$Xs=As-Bs(\text{msec}) \quad (1)$$

In the present example, the value of s is 1.

While switching detection windows based on the same principle for the remaining image forming stations, development contact timings X2, X3, and X4 are calculated by detecting the detection patterns 81. Thus, the timing detection principle is the same as in the first embodiment. The separation timing also can be determined in the same manner as in the first embodiment, by measuring the development separation completion passed time Cs.

$$Ys=Cs-Bs(\text{msec}) \quad (2)$$

In the present embodiment, a detection window for detecting the detection pattern 81 of each toner color is set. The detection window is switched before passing directly under the registration detection sensor 56. Thus, it is possible to detect the development contact timing of the development rollers 64 (64Y, 64M, 64C, and 64K) to the photosensitive drums 61 (61Y, 61M, 61C, and 61K) for each image forming station by one development contact operation. The separation timing of each image forming station also can be detected by the same principle. That is, it is possible to detect the development contact timing of the development rollers 64 (64Y, 64M, 64C, and 64K) to the photosensitive drums 61 (61Y, 61M, 61C, and 61K) for each image forming station by one development separation operation. Note that "before passing" needs to be determined in advance. Since the timing at which the detection pattern 81 is expected to pass can be roughly estimated, a window of a predetermined time is provided based on that rough estimation, and a timing for that window is determined. Since there may be instances where detection still is not possible, the window is closed after passage of the predetermined time even if detection cannot be performed. This window is a window in figurative terms, and actually, for example, the period in which output signals of the registration detection sensor 56 are monitored serves as a window.

Next is a description of the precision of detection of the development contact timing and the development separation timing when using a detection pattern 81, with reference to FIG. 18. A pattern interval H(mm) of the above-described one set is the sum of the pattern width W(mm) and the pattern interval I(mm) of each toner color, and can be calculated from formula (3-1).

$$H=(W+I)\times 4(\text{mm}) \quad (3\text{-}1)$$

The interval H(mm) of one set of patterns is the interval (pitch) from detection of the yellow toner pattern of the first set to detection of the yellow toner pattern of the second set, and so the pitch of the patterns of each toner color is the detection precision of the patterns of each color. That is, the detection precision of the development contact timing and the development separation timing of each image forming station corresponds to the pattern interval. For example, when the pattern width is 1 mm and the pattern interval is 1 mm for each color, the detection precision of the development contact timing and the development separation timing of each image forming station is, in terms of conveyance distance, $(1+1)\times 4=8$ mm. In this case, if the conveyance speed of the intermediate transfer belt 51 is 16 mm/sec, the detection precision is 0.5 seconds when converted to time. Therefore, in this example, the speed and start timing of the stepper motor 91 can be controlled in 0.5 sec units, and the time that the development roller 64 is contacted against the photosensitive drum 61 can be reduced in 0.5 sec units.

Flowchart of Control for Detecting Development Separation Timing

Next is a description of the method for controlling detection of the development contact timing and the development separation timing of the development rollers 64 (64Y, 64M, 64C, and 64K) to the photosensitive drums 61 (61Y, 61M, 61C, and 61K) for each image forming station by one development contact and separation operation.

Figure 19:
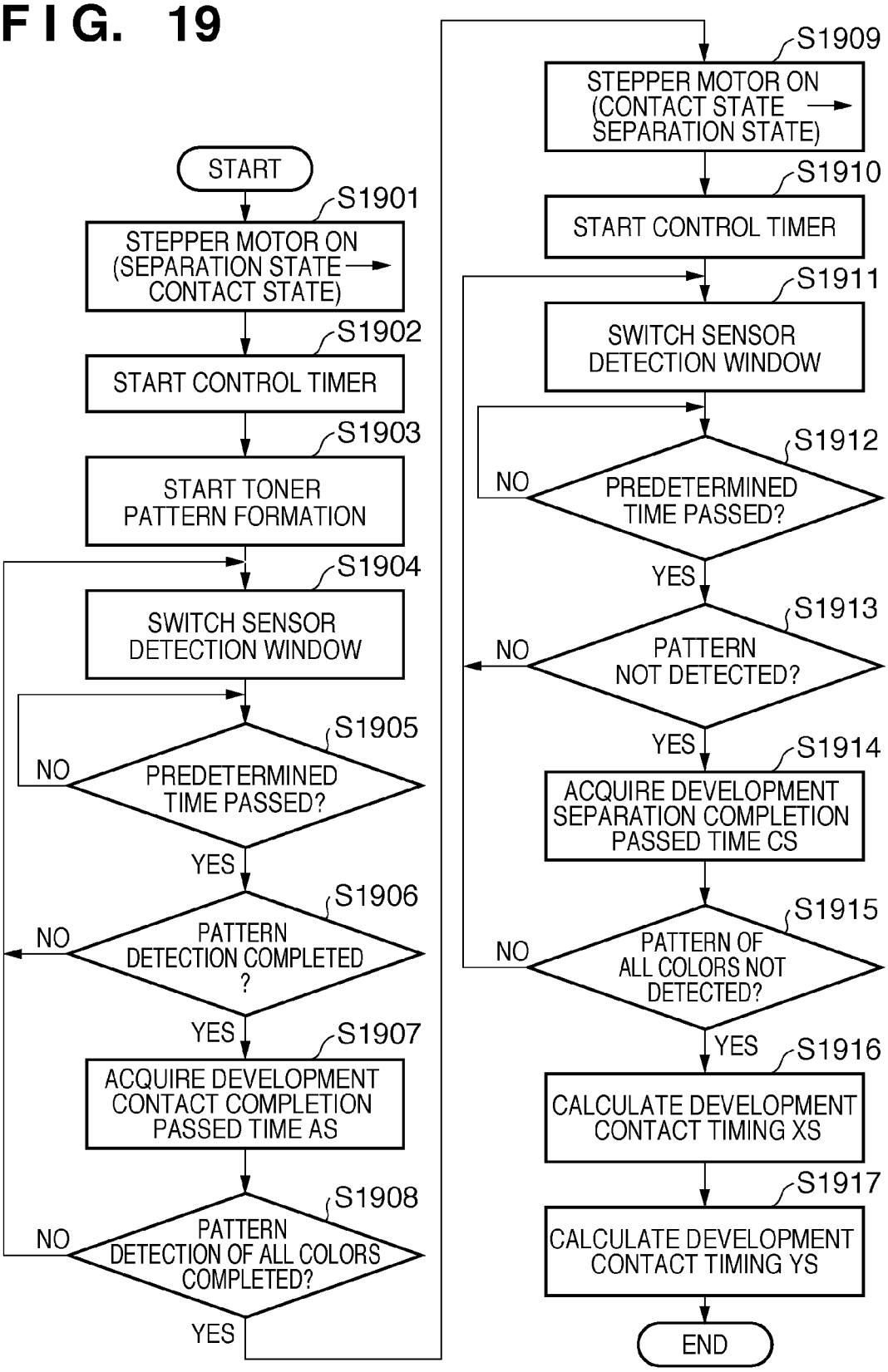
FIG. 19 is a flow diagram of a control program that detects timing of contact/separation of the photosensitive drum and the development roller in the third embodiment.

FIG. 19 shows a flowchart of control for detecting the development contact timing and the development separation timing for each image forming station by one development contact and separation operation. The sequence (hereinafter, the development contact timing and separation timing detection sequence) shown in FIG. 19 is executed when a door whereby a process cartridge can be exchanged is closed or when power is turned on.

The development contact timing and separation timing detection sequence is stored in the ROM 122 as a control sequence program for detecting the development contact timing and the development separation timing. When the development contact timing and separation timing detection sequence is started, the CPU 121 starts a motor that drives the photosensitive drum 61 and the intermediate transfer belt 51, and the scanner motor 182. Also, bias application and the like of the charging bias control unit 183, the development bias control unit 184, and the primary transfer bias control unit 185 is performed to start image forming preparation. Next, the stepper motor 91 is rotationally driven forward by a predetermined number of steps in order to start the development contact operation (S1901). When forward rotational driving of the stepper motor 91 starts, the control timer 17 is started (S1902). The stepper motor 91 is started, and while the development contact/separation state is indefinite, repeated formation of an electrostatic latent image of the detection patterns 81 on the photosensitive drum 61 is started (S1903). The detection window of the image forming station 1 is set to immediately before the timing when the electrostatic latent image formed on the photosensitive drum 61 of the image forming station 1 arrives directly below the registration detection sensor 56 (S1904). This timing is determined in advance. Next, the sequence awaits passage of the predetermined time set as the detection window of the image forming station 1 (S1905).

After the predetermined time has passed, the electrostatic latent image of the detection pattern 81 formed on the photosensitive drum 61 of the image forming station 1 is expected to arrive directly under the registration detection sensor 56. Consequently, when the detection pattern 81 is not detected at this timing (S1906), setting is switched to the detection window of the image forming station 2. Switching is performed after a predetermined time following the window. After setting is switched to the detection window of the image forming station 2, likewise in the image forming station 2, when the detection pattern 81 cannot be detected within the detection window, setting is switched to the detection window of the image forming station 3. After setting is switched to the detection window of the image forming station 3, likewise in the image forming station 3, when the detection pattern 81 cannot be detected within the detection window, setting is switched to the detection window of the image forming station 4. In this way, steps S1904 to S1906 are repeatedly executed until the detection pattern 81 is detected within the detection window.

When the detection pattern 81 was detected at the timing that the electrostatic latent image of the detection pattern 81 formed on the photosensitive drum 61 of the image forming station 1 arrives directly under the registration detection sensor 56 after passage of the predetermined time (S1906), the sequence moves to S1907. In Step S1907, a development contact completion passed time A1(msec) from starting of the control timer 17 until the detection pattern 81 of the image forming station 1 is detected in the detection window of the image forming station 1 by the registration detection sensor 56 is acquired. When the development contact completion passed time As(msec) of each image forming station is not detected (S1908), setting is switched to the detection window of the image forming station 2. In this way, switching of the detection window is repeatedly executed in steps S1904 to S1908 until the development contact completion passed time As(msec) of each image forming station is detected. When the development contact completion passed time As(msec) of each image forming station is detected (S1908), the stepper motor 91 is again rotationally driven forward by a predetermined number of steps in order to switch the development contact/separation state from the contact state to the separation state (S1909).

When forward rotational driving of the stepper motor 91 starts, the control timer 17 is started (S1910). For this principle, the detection pattern 81 of FIG. 17 is applied to the procedure of separation timing detection in the first embodiment. The detection window of the image forming station 1 is set to immediately before the timing when the electrostatic latent image formed on the photosensitive drum 61 of the image forming station 1 arrives directly below the registration detection sensor 56 (S1911). Next, the sequence awaits passage of the predetermined time set as the detection window of the image forming station 1 (S1912). After passage of the predetermined time, the electrostatic latent image of the detection pattern 81 formed on the photosensitive drum 61 of the image forming station 1 arrives directly under the registration detection sensor 56. When the detection pattern 81 is detected at that timing (S1913), the setting is switched to the detection window of the image forming station 2. After the setting is switched to the detection window of the image forming station 2, likewise in the image forming station 2, when the detection pattern 81 is detected within the detection window, the setting is switched to the detection window of the image forming station 3. After the setting is switched to the detection window of the image forming station 3, likewise in the image forming station 3, when the detection pattern 81 is detected within the detection window, the setting is switched to the detection window of the image forming station 4. In this way, steps S1911 to S1913 are repeatedly executed until the detection pattern 81 is no longer detected within the detection window.

When the detection pattern 81 is not detected at the timing that the electrostatic latent image of the detection pattern 81 formed on the photosensitive drum 61 of the image forming station 1 arrives directly under the registration detection sensor 56 after passage of the predetermined time (S1913), the sequence moves to S1914. In step S1914, a development contact/separation passed time C1(msec) is acquired. The development contact/separation passed time C1 is the time from starting the control timer 17 to the timing when the detection pattern 81 of the image forming station 1 is finally detected with the registration detection sensor 56 in the detection window of the image forming station 1. When the development contact/separation passed time Cs(msec) for each image forming station is not detected (S1915), the setting is switched to the detection window of the image forming station 2. In this way, switching of the detection window in steps S1911 to S1915 is repeatedly executed until the development contact/separation passed time Cs(msec) for each image forming station is detected. When the development contact/separation passed time Cs(msec) for each image forming station is detected (S1915), the development contact timing Xs(msec) is calculated from formula (1) and stored in the RAM (S1916). Also, the development separation timing Ys(msec) is calculated from formula (2) and stored in the RAM (S1917). With this processing, it is possible to detect the development contact timing and the development separation timing of the development rollers 64 (64Y, 64M, 64C, and 64K) to the photosensitive drums 61 (61Y, 61M, 61C, and 61K) for each image forming station by one development contact and separation operation.

Correction of Development Contact/Separation Timing

Next is a description of a method for correcting the development contact/separation timing when printing, based on the development contact timing Xs and the development separation timing Ys of each image forming station calculated by the development contact timing and separation timing detection sequence. This description is given with reference to the timing chart in FIG. 20.

Figure 20:
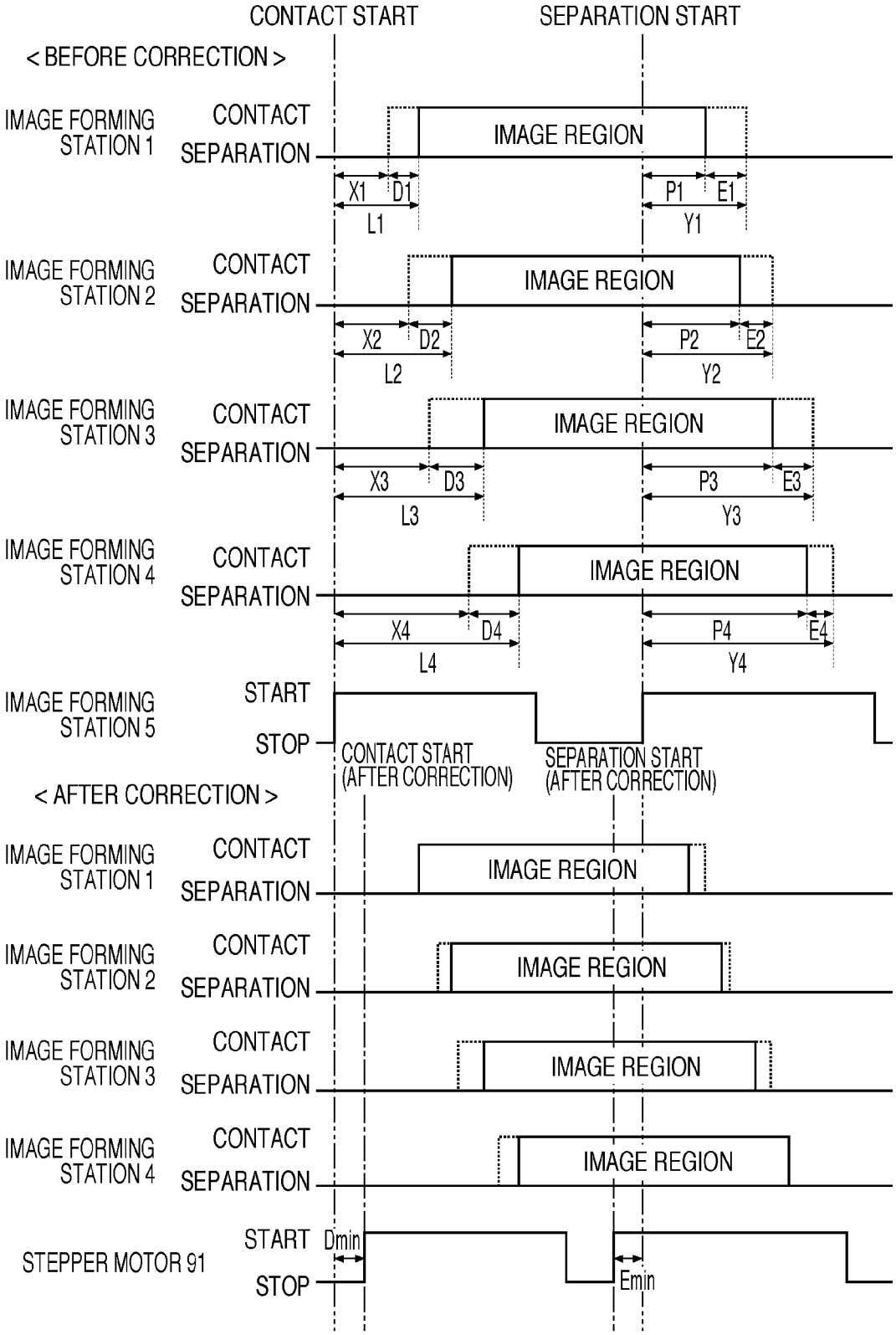
FIG. 20 shows a concept of a correction method for correcting timing of contact/separation of the photosensitive drum and the development roller in the third embodiment.

The broken lines in FIG. 20 indicate the timing when the development roller 64 and the photosensitive drum 61 are contacted and separated for each image forming station when the development contact timing and separation timing detection sequence has been performed. The solid lines indicate the latest timing when the development roller 64 and the photosensitive drum 61 contact when variation has been considered, and the earliest timing when the development roller 64 and the photosensitive drum 61 separate when variation has been considered. Xs and Xy prior to correction in FIG. 20 indicate the development contact timing Xs(msec) and the development separation timing Ys(msec) of each image forming station calculated by the development contact timing and separation timing detection sequence. Ls (where the value of s is 1 to 4) prior to correction in FIG. 20 indicates the latest timing when the development roller 64 and the photosensitive drum 61 contact when variation has been considered. Ps indicates the earliest timing when the development roller 64 and the photosensitive drum 61 separate when variation has been considered.

Below is a method for correcting the development contact timing in a printing operation.

(1) A variation error Ds for each image forming station is calculated from the difference of the development contact timing Xs(msec) and Ls(msec) calculated by the development contact timing and separation timing detection sequence.

(2) Among the variation errors Ds for each image forming station, a development contact correction time Dmin(msec) serving as the smallest variation error is determined.

(3) The start timing of the stepper motor 91 is delayed by the development contact correction time Dmin(msec).

By delaying the start timing of the stepper motor 91 as described above, it is possible to adopt an optimal contact timing for each station. In FIG. 20, an error variation D1(msec) of the image forming station 1 is smallest, so by delaying the start timing (contact start) of the stepper motor 91 by D1(msec), contact can be completed at an optimal timing.

Next, below is a method for correcting the development separation timing in a printing operation.

(4) A variation error Es for each image forming station is calculated from the difference of the development separation timing Ys(msec) and Ps(msec) calculated by the development contact timing and separation timing detection sequence.

(5) Among the variation errors Es for each image forming station, a development contact correction time Emin(msec) serving as the smallest variation error is determined.

(6) The start timing of the stepper motor 91 is accelerated by the development contact correction time Emin(msec).

By accelerating the start timing of the stepper motor 91 as described above, it is possible to adopt an optimal separation timing for each station. In FIG. 20, an error variation E4(msec) of the image forming station 4 is smallest, so be delaying the start timing (contact start) of the stepper motor 91 by E4(msec), contact can be completed at an optimal timing.

Here, a plurality of stations are controlled with one drive source, so the contact timing is controlled in coordination with the smallest error variation D1(msec), but when the respective stations have independent drive sources, control of an optimal contact timing in coordination with the detection results of the respective stations is possible. Likewise, the separation timing is controlled in coordination with the smallest error variation E4(msec), but when the respective stations have independent drive sources, control of an optimal contact timing in coordination with the detection results of the respective stations is possible.

Furthermore, coordination of the contact timing and the separation timing with the image forming guarantee time was described, but it is possible, for example, to have a receiving means for receiving information regarding the size of an image formed from a controller, and when an engine knows the size of images to be formed in each color, to coordinate the contact timing and the separation timing with the size of the images to be formed in the respective colors, rather than with the image forming guarantee time.

When the respective stations can be independently driven in this way, the contact time can be optimally controlled in each station, so wear of the development roller 64 and the photosensitive drum 61 can be reduced. Also, because the size of the images to be formed in the respective colors is known, the contact time can be controlled in coordination with the images to be formed, so wear of the development roller 64 and the photosensitive drum 61 can be reduced even further.

As described above, in any combination of the development contact/separation mechanism and process cartridges P (PY, PM, PC, and PK) included in the main body apparatus 2, latent image patterns are repeatedly formed such that the detection patterns 81 of different colors are in contact without overlapping. The registration detection sensor 56 can detect the patterns on the intermediate transfer belt 51 after contact and separation are completed. The time between the start timing of the stepper motor 91 and the detection timing of the detection pattern 81 is measured in windows of the respective stations. Thus, it is possible to detect an optimal development contact timing and separation start timing in a minimal amount of required time. Thus, the development contact timing and the separation start timing can be corrected such that the time of contact is no longer than necessary. As a result, it is possible to provide an image forming apparatus in which wear of the development roller 64 and the photosensitive drum 61 can be reduced, and thus shortening of the life of process cartridges can be prevented.

Fourth Embodiment

Figure 24:
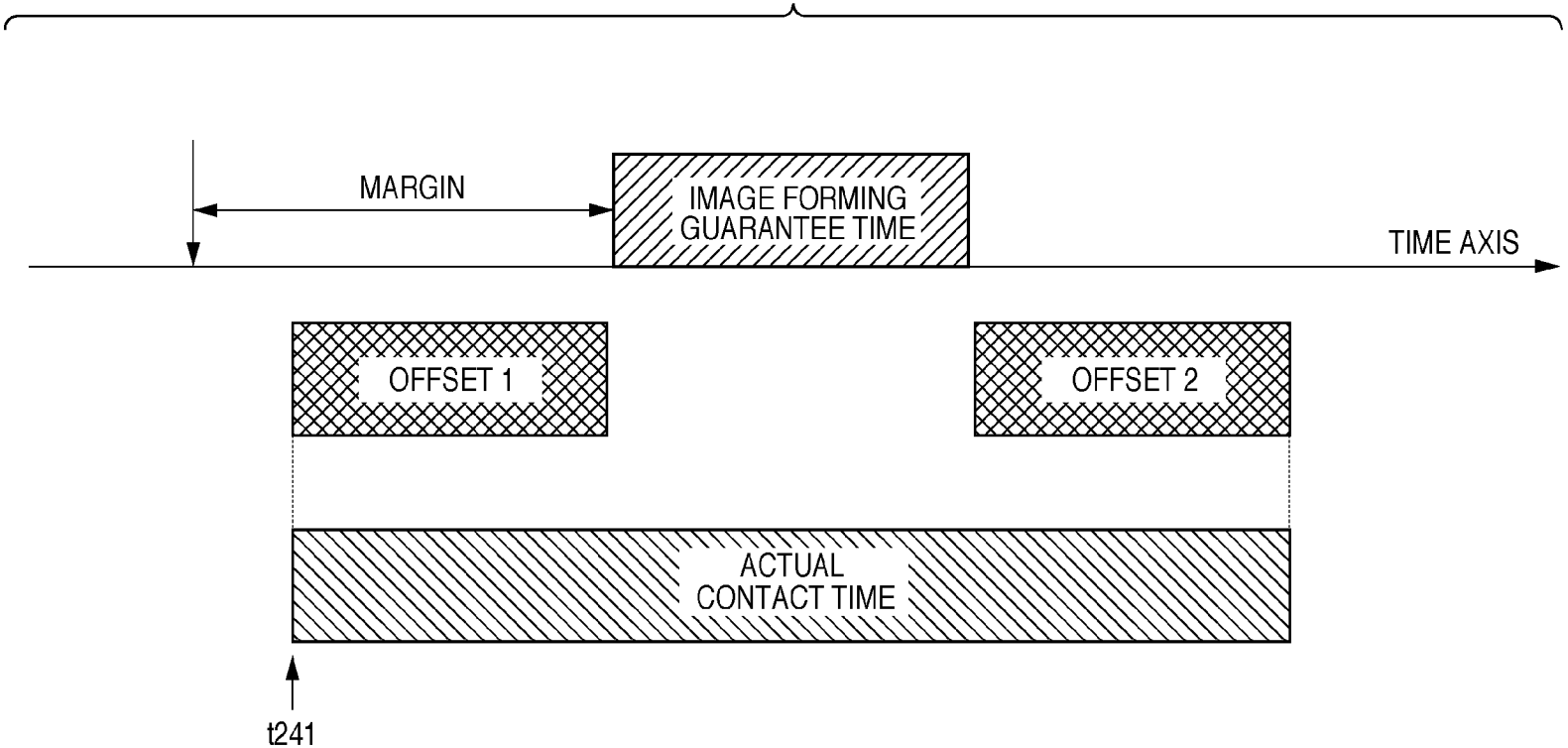
FIG. 24 shows an example of timing of contact/separation of a photosensitive drum and a development roller relevant to problems in the related art.

In the fourth embodiment, a description is given of an image forming apparatus and control method thereof in which wear of the photosensitive drum 61 that contacts the intermediate transfer belt 51 due to attractive force occurring between the intermediate transfer belt 51 and the photosensitive drum 61 is prevented, thus extending the life of the photosensitive drum 61. A charging bias is applied to the photosensitive drum 61 prior to image forming (including a margin) to charge the photosensitive drum 61 even while not contacted with the development roller 64. The intermediate transfer belt 51 is also charged by a transfer bias applied during transfer of a toner image. Since these loads act in the direction of attraction to each other, even when image forming is not being performed, the intermediate transfer belt 51 and the photosensitive drum 61 contact each other due to charging, causing wear of the surface of the photosensitive drum 61 if there is a speed difference between them. In the present embodiment, this is prevented. Also, the present embodiment may be combined with the first to third embodiments, but here, by way of example, a description is given of an image forming apparatus operating in the development contact/separation state as shown in FIG. 24.

Timing of Application of Transfer Bias and Charging Bias

Figure 21:
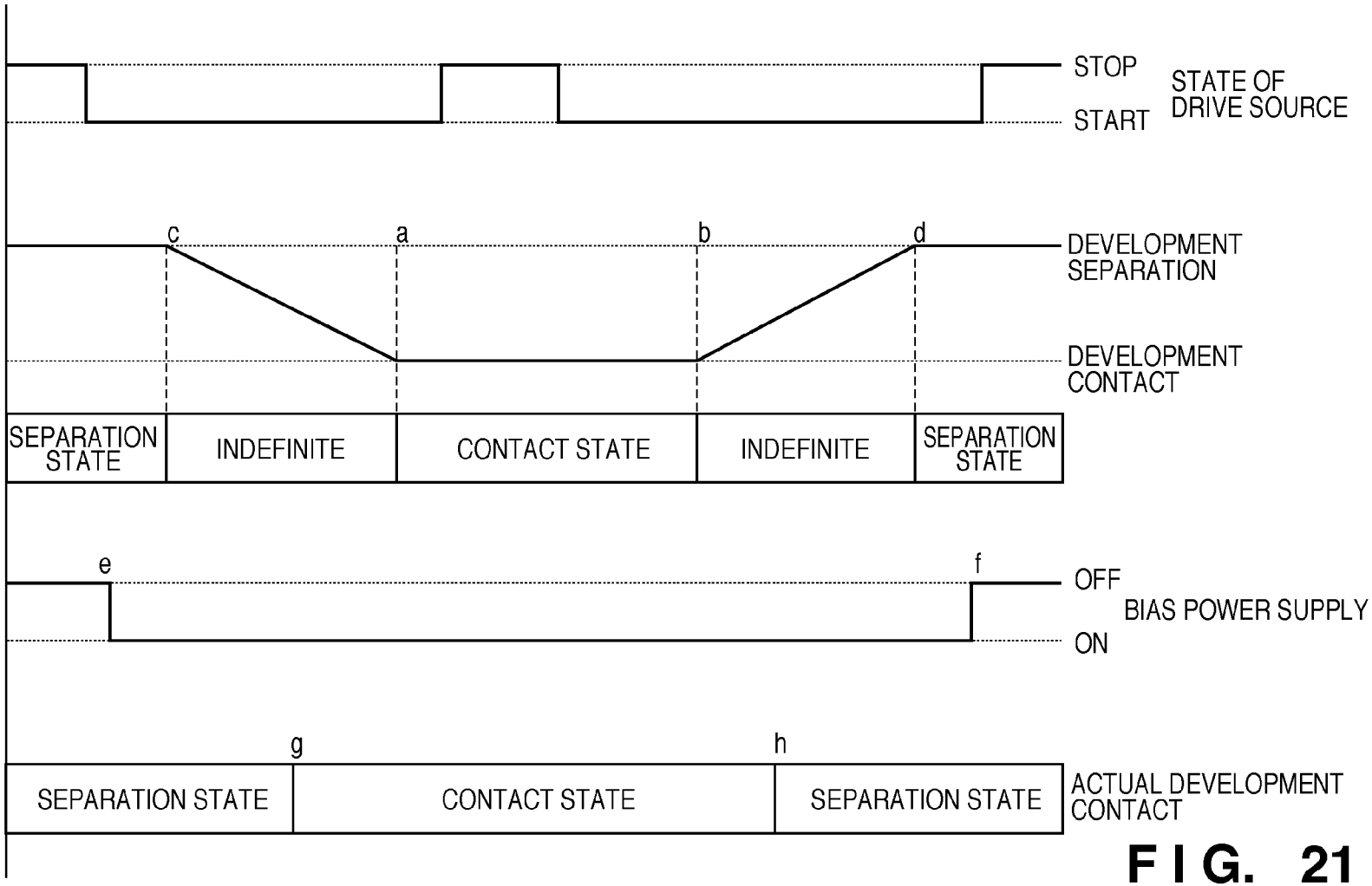
FIG. 21 is a timing diagram that shows the timing for applying a charging bias to a photosensitive drum, and applying a transfer bias to a development roller, in a fourth embodiment.

The timing of application of the transfer bias and the charging bias according to the present embodiment will be described in detail with reference to FIG. 21. FIG. 21 shows an overview of a separation cam 80*a* in the yellow (Y) image forming station (1st), and the timing at which the transfer bias and the charging bias are applied.

As shown in FIG. 21, the separation cam 80*a* is rotationally driven, and the region while the development roller 64 is moving from the separation state to the contact state with the photosensitive drum 61 is in a so-called indefinite state. In the indefinite state, the contact timing becomes offset. Thus, it is necessary to apply the transfer bias and the charging bias early, with some margin (timing e) from the time (c) when the indefinite region is started. This is in order to prevent toner from being transferred to the photosensitive drum 61 when the development roller 64 is contacted against the photosensitive drum 61. In the main body and process cartridge where variation in components or assembly actually occurs, development contact occurs (g) after passage of a fixed time from the time (c) when the indefinite region is started. Therefore, the time (e to g) from application of the transfer bias and the charging bias to contact of the development roller 64 against the photosensitive drum 61 becomes long, and during that time, a large attractive force occurs between the intermediate transfer belt 51 and the photosensitive drum 61. This accelerates planing of the photosensitive drum 61.

Also, the same sort of variation is present in the region in which the development roller 64 is moving from the contact state to the separation state from the photosensitive drum 61. Therefore, it is necessary to stop the transfer bias and the charging bias with some margin (timing f) from the time (d) when the indefinite region is completed. In the main body and process cartridge where variation in components or assembly actually occurs, development separation occurs (h) after passage of a fixed time from the time (b) when the indefinite region is started. Therefore, the time (h to f) from separation of the development roller 64 from the photosensitive drum 61 to stopping of the transfer bias and the charging bias becomes long, and during that time, a large attractive force occurs between the intermediate transfer belt 51 and the photosensitive drum 61. This accelerates planing of the photosensitive drum 61.

Figure 22:
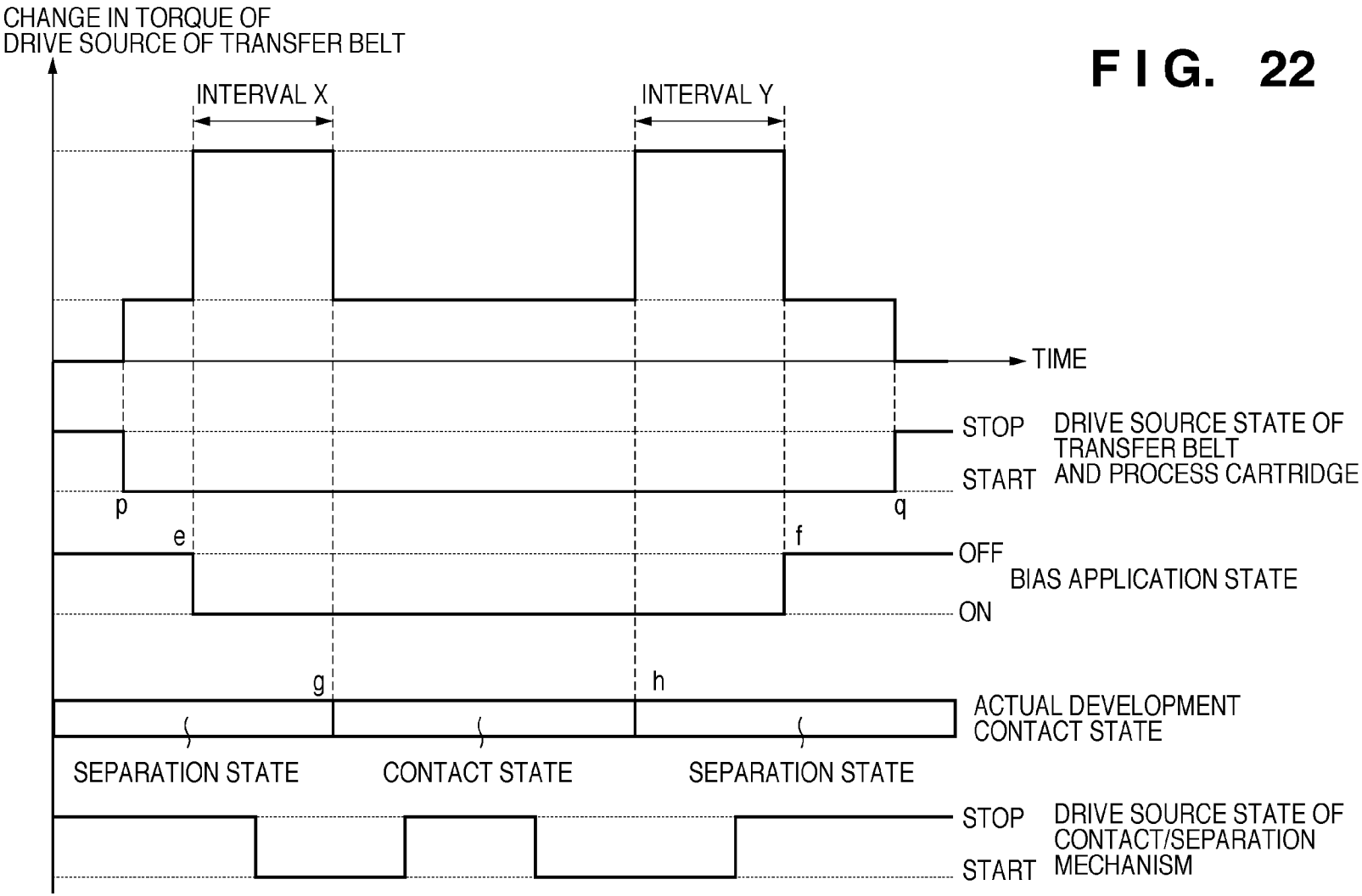
FIG. 22 is a timing diagram that shows drive timing and bias application timing of an intermediate transfer belt in the fourth embodiment.

When the transfer bias and the charging bias are applied in the state in which the development roller 64 is separated from the photosensitive drum 61, a large attractive force occurs between the intermediate transfer belt 51 and the photosensitive drum 61. This phenomenon will be described with focus on a torque change of the drive source of the intermediate transfer belt 51. FIG. 22 shows an overview of the torque change of the drive source of the intermediate transfer belt 51, the contact timing and separation timing of the development roller 64, the timing of application of the transfer bias and charging bias, and the start state of the drive source of the intermediate transfer belt 51, process cartridge, and contact/separation mechanism.

FIG. 22 illustrates operation from sending of an image signal to the main body to printing of an image. As shown in FIG. 22, when the drive source of the intermediate transfer belt 51 and a drive motor provided for each process cartridge are started (p), a small amount of torque occurs in the drive source of the intermediate transfer belt 51. When the transfer bias and the charging bias are applied (e), a large attractive force occurs between the intermediate transfer belt 51 and the photosensitive drum 61, a large torque occurs in the drive source of the intermediate transfer belt 51, and planing of the photosensitive drum 61 is accelerated. Even when a large attractive force occurs in the intermediate transfer belt 51 and the photosensitive drum 61, if the speed of the intermediate transfer belt 51 and the photosensitive drum 61 is the same, a large torque will not occur and so planing of the photosensitive drum 61 will not occur. However, a speed difference in the drive speed of the intermediate transfer belt 51 and the photosensitive drum 61 occurs due to variation in the diameter of the photosensitive drum 61, variation in thickness of the intermediate transfer belt 51, variation in the diameter of the drive roller 53 of the intermediate transfer belt 51, and so forth. Therefore a large torque occurs, and so planing of the photosensitive drum 61 occurs. In a state in which this large torque is occurring, the stepper motor 91 serving as the drive source of the contact/separation mechanism is driven, and the development roller 64 contacts against the photosensitive drum 61 (*g*). Thus, because a low-friction substance such as toner is present between the intermediate transfer belt 51 and the photosensitive drum 61, the torque occurring in the drive source of the intermediate transfer belt 51 is small. That is, in a state in which the development roller 64 is contacted against the photosensitive drum 61, even if there is a speed difference between the intermediate transfer belt 51 and the photosensitive drum 61, the intermediate transfer belt 51 and the photosensitive drum 61 slide due to the presence of toner therebetween, and so there is little occurrence of planing of the photosensitive drum 61.

Next is a description of operation from when printing of an image is ended to stoppage of the main body. In a state in which the development roller 64 is contacted against the photosensitive drum 61, the stepper motor 91 is driven, and the development roller 64 separates from the photosensitive drum 61 (*h*). As a result, there is no longer a low-friction substance such as toner interposed between the intermediate transfer belt 51 and the photosensitive drum 61, so a large torque occurs in the drive source of the intermediate transfer belt 51, and planing of the photosensitive drum 61 is accelerated. When the transfer bias and the charging bias are stopped (f), there is no longer an attractive force between the intermediate transfer belt 51 and the photosensitive drum 61, so there is little torque in the drive source of the intermediate transfer belt 51. Finally, the drive source of the intermediate transfer belt 51 and the drive motor of the process cartridge are stopped.

In the periods (interval X and interval Y) in which a large torque is occurring in the drive source of the intermediate transfer belt 51, a speed difference exists in the state in which the intermediate transfer belt 51 and the photosensitive drum 61 are attracted. Therefore, sliding wear occurs between the intermediate transfer belt 51 and the photosensitive drum 61, so planing of the photosensitive drum 61 is accelerated. Also, the problem of the time that the transfer bias and the charging bias are applied being longer than the time that the development roller 64 is contacted against the photosensitive drum 61 occurs similarly in each image forming station. Consequently, the development contact or separation timing in each image forming station is detected, and the application time of the transfer bias and the charging bias in each image forming station are respectively adaptively adjusted.

Detection of Development Contact Timing and Separation Timing, and Bias Application Timing Method Next is a detailed description of method for detecting and optimizing the development contact timing and separation timing according to the present example, with reference to FIG. 23. FIG. 23 is a flowchart of a control program for detecting the development contact timing and separation timing. In the present embodiment, the bias application timing is adjusted in the same manner as in the first embodiment. That is, in the second and third embodiments, the margin of the development contact/separation timing was shortened, and here, in the same manner the margin of the timing for application of the charging bias and the transfer bias is shortened.

As shown in FIG. 23, first detection of whether or not a process cartridge has been exchanged is performed (S2301). When determined that a process cartridge has been exchanged, control to detect the development contact timing and separation timing is started, and a drive source (excluding the stepper motor 91) of the photosensitive drum 61 and the intermediate transfer belt 51 and the like is started (S2302). Then, the detection pattern 81 is formed (S2303), and by starting the stepper motor 91, the operation of contacting the development roller 64 against the photosensitive drum 61 is started (S2304). At this time, a timer is started at the drive start timing of the stepper motor 91. The detection pattern 81 made visible by the development roller 64 contacting against the photosensitive drum 61 is detected by the registration detection sensor 56 (S2305), and the stepper motor 91 is stopped in the full-color state (S2306). The timer is stopped when the leading edge of the detection pattern 81 is detected. The time (contact time) thus measured from starting the stepper motor 91 to detection is stored (S2307).

On the other hand, the stepper motor 91 is started from the full-color contact state, in which the development roller 64 is contacted (S2308). Here a timer is started at the drive start timing of the stepper motor 91. The detection pattern 81 that has become an electrostatic latent image due to the development roller 64 separating is detected by the registration detection sensor 56 (S2309), and the stepper motor 91 is stopped in the standby state (S2310). The timer is stopped when the trailing edge of the detection pattern 81 is detected. The time (separation time) thus measured from starting the stepper motor 91 until detection is no longer possible is stored (S2311).

Thus, the contact time and the separation time are detected in each station (S2312). The manner of this operation is the same as in the first embodiment. The timing when the transfer bias and the charging bias are applied is changed in accordance with the contact time of each station.

The timing is determined such that in each station, the time from application of the transfer bias and the charging bias to contact of the development roller 64 against the photosensitive drum 61 is as short as possible. The timing when the transfer bias and the charging bias are stopped is changed in accordance with the separation time of each station. The timing is determined such that in each station, the time from separation of the development roller 64 from the photosensitive drum 61 to stoppage of the transfer bias and the charging bias is as short as possible (S2313). That is, this timing adjustment is performed such that the intervals X and Y in FIG. 22 are as short as possible. In order to do so, in the same manner as in the first and third embodiments, the development contact timing and the development separation timing are determined, and application and stoppage of bias are respectively performed in accordance with that timing.

For example, the values Xs=As−Bs and Ys=Cs−Bs calculated in the first embodiment can be used for the bias timing offset amount. That is, Xs can delay the bias application timing from the predetermined timing e in FIG. 22. Also, the bias application timing can be accelerated by Ys from the predetermined timing f in FIG. 22. That is, the bias timing is adjusted by the adjustment amount obtained when adjusting the drive timing of the development roller 64 (or by the same control amount, or by the same time).

Therefore, rather than performing the time measurement only for control in the present embodiment, it is possible to use the times As and Cs measured by control of the drive timing of the stepper motor 91 for adjustment of the development contact timing and the development separation timing performed in the first to third embodiments. Also, the time measurement according to the second embodiment is the time itself of the detection pattern 81, and thus differs from the first embodiment, but as described in the second embodiment, these are values that can be converted to each other, so it is also possible to use the time measured in the manner described in the second embodiment.

As described above, in the combination of the main body and the process cartridge that is actually used, development contact and separation are performed, and the leading edge and trailing edge of the detection pattern 81 transferred onto the intermediate transfer belt 51 are detected with the registration detection sensor 56. By adopting such a configuration, it is possible to accurately know the development contact time and the development separation time in each combination. Thus, when an image signal has been sent to the main body, it is possible to apply the transfer bias and the charging bias such that the transfer bias and the charging bias are applied for as short a time as possible relative to the detected development contact time of each station.

Thus, it is possible to optimally correct the application timing and the stop timing of the transfer bias and the charging bias according to the development separation timing. As a result, it is possible to apply the transfer bias and the charging bias for a minimal amount of time relative to the time that the development roller 64 is contacted against the photosensitive drum 61. Therefore, it is possible to provide a means whereby it is possible to reduce planing of the photosensitive drum 61, which is beneficial for the process cartridge life.

In the description of the present example, the detection pattern 81 is formed as an electrostatic latent image on the photosensitive drum 61, in the period from the start of contact of the development roller 64 to completion of contact, and in the period from the start of separation of the development roller 64 to completion of separation. However, the detection pattern 81 may also be formed as an electrostatic latent image on the photosensitive drum 61 in the period from the start of contact to completion of separation.

The present invention is also applicable to a system configured with a plurality of devices (for example, such as a host computer, an interface device, a reader, a printer, and so forth), and also applicable to an apparatus constituted of single device (for example, such as a copier or a facsimile apparatus). Each step of the present invention can be realized by executing software (a program) acquired via a network or various recording media with a processing apparatus (such as a CPU or processor) such as a personal computer.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2009-141621, filed Jun. 12, 2009 and 2010-041005, filed Feb. 25, 2010, which are hereby incorporated by reference herein in their entirety.

What is claimed is:

1. An image forming apparatus comprising:

an image carrier on which a latent image is formed;

a developer carrier configured to be capable of contact against or separation from the image carrier, wherein the developer carrier carries toner and forms a toner image on the image carrier by contact with the image carrier at a developing position;

a detector which detects, in a test mode, a toner image developed by bringing the developer carrier into contact with the image carrier at the developing position when the latent image formed on the image carrier is passing the developing position from a state that the developer carrier is separate from the image carrier; and a controller adapted to control, in an image forming mode, the contact operation to put the image carrier and the developer carrier in contact based on the detection results detected by the detector in the test mode.

2. An image forming apparatus according to claim 1, wherein the controller controls a timing at which contact operation by the developer carrier starts in the image forming mode based on a time period from starting a contact operation by the developer carrier to detecting the toner image by the detector in the test mode.

3. An image forming apparatus according to claim 2, wherein the controller, using a difference between a leading edge of a latent image formed on the image carrier and a leading edge of the toner image detected by the detector in the test mode, obtains a first time from a state in which the developer carrier and the image carrier are separated until the developer carrier and the image carrier are in contact.

4. An image forming apparatus according to claim 3, further comprising a driver adapted to drive the developer carrier in order to cause the developer carrier and the image carrier to be in contact or separated;

wherein the controller controls, in the image forming mode, a drive speed or a drive timing of the driver, or both the drive speed and the drive timing, according to the first time.

5. An image forming apparatus according to claim 3, further comprising:

a plurality of the image carriers; and a plurality of the developer carriers that respectively correspond to the plurality of image carriers;

wherein in the test mode the detector detects toner images of different colors formed respectively on the plurality of image carriers, and the controller uses a plurality of detection results detected by the detector to obtain a plurality of the first times, and controls the contact operation in the image forming mode according to the longest time among the plurality of first times.

6. An image forming apparatus according to claim 5, further comprising a transfer member onto which the toner images developed by the image carriers are transferred;

wherein the controller performs control such that the respective toner images formed on the plurality of image carriers are transferred at different positions of the transfer member.

7. An image forming apparatus according to claim 5, wherein as the toner images, the toner images of a plurality of colors are periodically formed in a conveyance direction of the transfer member, and the controller obtains the first times according to the plurality of detection results detected by the detector in the test mode.

8. An image forming apparatus according to claim 3, wherein the image carrier and the developer carrier are configured as a cartridge removable from the image forming apparatus, and when the cartridge is installed, in the test mode the detector detects the toner image formed on the image carrier included in the installed cartridge.

9. An image forming apparatus according to claim 3, further comprising:

a charger adapted to charge the image carrier; and a transfer unit adapted to transfer a toner image developed by the image carrier to a transfer member;

wherein the controller controls application of a bias by the charger and application of a bias by the transfer unit in the image forming mode according to the first time.

10. An image forming apparatus according to claim 3, further comprising:

a plurality of drivers adapted to drive the developer carrier in order to cause the developer carrier and the image carrier to be in contact or separated; and a receiver adapted to receive the size of a toner image to be formed by the developer of each color;

wherein, in the image forming mode, the controller, according to the first time, controls a drive speed or a drive timing of the drivers, or both the drive speed and the drive timing, according to the size of the image of each color.

11. An image forming apparatus comprising:

an image carrier on which a latent image is formed;

a developer carrier configured to be capable of contact against or separation from the image carrier, wherein the developer carrier carries toner and forms a toner image on the image carrier by contact with the developer carrier at a developing position;

a detector which detects, in a test mode, a toner image for which development is to be finished by separating the developer carrier from the image carrier when the latent image formed on the image carrier is developed from a state that the developer carrier is in contact with the image carrier; and a controller adapted to control, in an image forming mode, a separation operation to separate the image carrier and the developer carrier based on the detection results detected by the detector in the test mode.

12. An image forming apparatus according to claim 11, wherein the controller controls a timing at which the separation operation of the developer carrier starts in the image forming mode based on a time period from starting the separation operation of the developer carrier to a timing when no toner image is detected by the detector in the test mode.

13. An image forming apparatus according to claim 12, wherein the controller, using a timing when the separation operation to separate the image carrier from the developer carrier is started and a timing when the developed toner image is no longer detected by the detector in the test mode, obtains a second time from a state in which the developer carrier and the image carrier are in contact until the developer carrier and the image carrier are separated.

14. An image forming apparatus according to claim 13, further comprising a driver for driving the developer carrier in order to cause the developer carrier and the image carrier to be in contact or separated;

wherein the controller controls, in the image forming mode, a drive speed or a drive timing of the driver, or both the drive speed and the drive timing, according to the second time.

15. An image forming apparatus according to claim 13, comprising:

a plurality of the image carriers; and a plurality of the developer carriers that respectively correspond to the plurality of image carriers;

wherein in the test mode the detector detects toner images of different colors formed respectively on the plurality of image carriers, and the controller uses a plurality of detection results detected by the detector to obtain a plurality of the second times, and controls the separation operation in the image forming mode based on the shortest time among the plurality of second times.

16. An image forming apparatus according to claim 15, further comprising a transfer member onto which the toner images developed by the image carriers are transferred;

wherein the controller performs control such that the respective toner images formed on the plurality of image carriers are transferred at different positions of the transfer member.

17. An image forming apparatus according to claim 16, wherein as the toner images, the toner images of a plurality of colors are periodically formed in a conveyance direction of the transfer member, and the controller obtains the second times based on the plurality of detection results detected by the detector in the test mode.

18. An image forming apparatus according to claim 13, wherein the image carrier and the developer carrier are configured as a cartridge removable from the image forming apparatus, and when the cartridge is installed, in the test mode the detector detects the toner image formed on the image carrier included in the installed cartridge.

19. An image forming apparatus according to claim 13, further comprising:

a charger adapted to charge the image carrier; and a transfer unit adapted to transfer a toner image developed by the image carrier to a transfer member;

wherein the controller controls application of a bias by the charger and application of a bias by the transfer unit in the image forming mode based on the second time.

20. An image forming apparatus according to claim 13, further comprising:

a plurality of drivers adapted to drive the developer carrier in order to cause the developer carrier and the image carrier to be in contact or separated; and a receiver adapted to receive the size of a toner image to be formed by the developer of each color;

wherein, in the image forming mode, the controller, according to the second time, controls a drive speed or a drive timing of the driver, or both the drive speed and the drive timing, based on the size of the image of each color.

21. An image forming apparatus comprising:

an image carrier;

a latent image forming unit configured to form an electrostatic latent image on the image carrier;

a developer carrier configured to carry toner and configured to be in contact with the image carrier at a developing position to form a toner image by developing the latent image;

a driving unit configured to selectively move the developer carrier to either a contact position where the developer carrier is in contact with the image carrier or a separation position where the developer carrier is separate from the image carrier;

a detection unit configured to detect a moving toner image at a detection position provided downstream in a conveyance direction of the toner image; and a control unit configured to perform a reference toner image detection mode and control a contact timing of the developer carrier to the image carrier in an image forming mode in accordance with the detection result of the reference toner image detection mode, wherein, in the reference toner image detection mode, the control unit makes the latent image forming unit form a predetermined reference latent image on the image carrier, makes the driving unit move the developer carrier from the separation position to contact with the image carrier on an area of the reference latent image formed on the image carrier when the area of the reference latent image passes the developing position in order to form a reference toner image by developing the reference latent image, and makes the detection unit detect a leading edge of the reference toner image at the detection position, and in the image forming mode, the control unit controls a contact start timing and/or a contact speed of the driving unit in accordance with a detected timing of the leading edge of the reference toner image detected by the detection unit.

22. The apparatus according to claim 21, further comprising:

a charging unit configured to charge the image carrier; and a transfer unit configured to transfer a toner image formed on the image carrier to a transfer member, wherein in the image forming mode, the control unit controls a start timing of applying a charging bias to the charging unit and/or a start timing of applying a transfer bias to the transfer unit in accordance with the detected timing of the leading edge of the reference toner image.

23. An image forming apparatus comprising:

an image carrier;

a latent image forming unit configured to form an electrostatic latent image on the image carrier;

developer carrier configured to carry toner and configured to be in contact with the image carrier at a developing position to form a toner image by developing the latent image;

a driving unit configured to selectively move the developer carrier to either a contact position where the developer carrier is in contact with the image carrier or a separation position where the developer carrier is separate from the image carrier;

a detection unit configured to detect a moving toner image at a detection position provided downstream in a conveyance direction of the toner image; and a control unit configured to perform a reference toner image detection mode and control a separation timing of the developer carrier from the image carrier in an image forming mode in accordance with the detection result of the reference toner image detection mode, wherein, in the reference toner image detection mode, the control unit makes the latent image forming unit form a predetermined reference latent image on the image carrier, develops the reference latent image to form a reference toner image by the developer carrier positioned at the contact position, then makes the driving unit move the developer carrier from the contact position to the separation position to separate from an area of the reference latent image formed on the image carrier when the area of the reference latent image passes the developing position in order to finish formation of the reference toner image, and makes the detection unit detect a trailing edge of the reference toner image at the detection position, and in the image forming mode, the control unit controls a separation start timing and/or a separation speed of the driving unit in accordance with a detected timing of the trailing edge of the reference toner image detected by the detection unit.

24. The apparatus according to claim 23, further comprising:

a charging unit configured to charge the image carrier; and a transfer unit configured to transfer a toner image formed on the image carrier to a transfer member, wherein in the image forming mode, the control unit controls an end timing of applying a charging bias to the charging unit and/or an end timing of applying a transfer bias to the transfer unit in accordance with the detected timing of the trailing edge of the reference toner image.

25. An image forming apparatus comprising:

image carriers disposed in series in a predetermined direction;

a latent image forming unit configured to form electrostatic latent images on the image carriers, respectively;

developer carriers configured to carry toner and configured to be in contact with the respective image carriers at respective developing positions to form toner images having different colors by developing the latent images;

a driving unit configured to selectively move the developer carriers to either respective contact positions where the developer carriers are in contact with the image carriers, or respective separation positions where the developer carriers are separate from the image carriers, wherein the driving unit comprises a driving source and a driving force transmission unit for transmitting a driving force of the driving source to respective developer carriers to make the respective developer carriers contact with/separate from the corresponding image carriers;

a transfer unit which comprises a transfer member that is conveyed through respective toner transfer positions of the image carriers and a voltage applying unit configured to apply a transfer bias to the transfer member in order to transfer the toner images from the respective image carriers to the transfer member;

a detection unit configured to detect moving toner images transferred to the transfer member at a detection position provided downstream of the image carriers in a conveyance direction of the transfer member; and a control unit configured to perform a reference toner image detection mode and control contact timings of the respective developer carriers to the respective image carriers in an image forming mode in accordance with the detection result of the reference toner image detection mode, wherein, in the reference toner image detection mode, the control unit performs a step of making the latent image forming unit act to form predetermined reference latent images of the respective different colors on the respective image carriers, a step of making the drive source act to move the developer carriers from the separation position via the driving force transmission unit to contact the respective image carriers at areas of the respective reference latent images formed on the respective image carriers when the areas of the reference latent images pass the respective developing positions in order to form reference toner images by developing the reference latent images, a step of making the transfer unit transfer the reference toner images to the transfer member, and a step of making the detection unit detect respective leading edges of the reference toner images at the detection position, and in the image forming mode, the control unit controls a contact start timing and/or a contact speed of the drive source in accordance with a detected timing of a leading edge of a reference toner image in a color corresponding to the longest elapsed time among elapsed times for the respective different colors, wherein each elapsed time is a time period from start of moving of the corresponding developer carrier from its separation position to the detected timing of the leading edge of the reference toner image in a corresponding color detected by the detection unit.

26. The apparatus according to claim 25, wherein the force transmission unit includes cams driven by the drive force supplied from the drive source, which are provided for respective developer carriers, the cams are assembled with different phases, and respective developer carriers are switched between contact positions and separation positions in an order by rotating the cams assembled with different phases.

27. An image forming apparatus comprising:

image carriers disposed in series in a predetermined direction;

a latent image forming unit configured to form electrostatic latent images on the image carriers, respectively;

developer carriers configured to carry toner and configured to be in contact with the respective image carriers at respective developing positions to form toner images having different colors by developing the latent images;

a driving unit configured to selectively move the developer carriers to either respective contact positions where the developer carriers are in contact with the image carriers, or respective separation positions where the developer carriers are separate from the image carriers, wherein the driving unit comprises a driving source and a driving force transmission unit configured to transmit a driving force of the driving source to respective developer carriers to make the respective developer carriers contact with/separate from the corresponding image carriers;

a transfer unit which comprises a transfer member that is conveyed through respective toner transfer positions of the image carriers and a voltage applying unit configured to apply a transfer bias to the transfer member in order to transfer the toner images from the respective image carriers to the transfer member;

a detection unit configured to detect moving toner images transferred to the transfer member at a detection position provided downstream of the image carriers in a conveyance direction of the transfer member; and a control unit configured to perform a reference toner image detection mode and control separation timings of the respective developer carriers to the respective image carriers in an image forming mode in accordance with the detection result of the reference toner image detection mode, wherein, in the reference toner image detection mode, the control unit performs a step of making the latent image forming unit form predetermined reference images on the respective image carriers, a step of developing the respective reference latent images to form reference toner images by the respective developer carriers positioned at the respective contact positions and making the transfer unit transfer the reference toner images to the transfer member, a step of making the driving unit move the respective developer carriers from the respective contact positions to the respective separation positions to separate from respective areas of the reference latent images formed on the respective image carriers when the areas of the reference latent images pass the respective developing positions in order to finish formation of the respective reference toner images, and a step of making the detection unit detect trailing edges of the reference toner images at the respective detection positions, and in the image forming mode, the control unit controls a separate start timing and/or a separate speed of the drive source in accordance with a detected timing of a trailing edge of a reference toner image in a color corresponding to the shortest elapsed time among elapsed times for the respective different colors, wherein each elapsed time is a time period from start of moving of the corresponding developer carrier from its contact position to the detected timing of the trailing edge of the reference toner image in a corresponding color detected by the detection unit.

28. The apparatus according to claim 27, wherein the force transmission unit includes cams driven by the drive force supplied from the drive source, which are provided for respective developer carriers, the cams are assembled with different phases, and respective developer carriers are switched between contact positions and separation positions in an order by rotating the cams assembled with different phases.

* * * * *